US007709761B1

(12) United States Patent
Dodal et al.

(10) Patent No.: US 7,709,761 B1
(45) **Date of Patent: *May 4, 2010**

(54) ELECTRICAL DEVICE CRADLE WITH MULTIPLE INTEGRAL SUPPORT REGIONS

(75) Inventors: Rohit Dodal, Peachtree City, GA (US); Gunter Gallas, Woodbury, NY (US)

(73) Assignee: Cooper Technologies Company, Houston, TX (US)

( * ) Notice: Subject to any disclaimer, the term of this patent is extended or adjusted under 35 U.S.C. 154(b) by 535 days.

This patent is subject to a terminal disclaimer.

(21) Appl. No.: 11/689,284

(22) Filed: Mar. 21, 2007

(51) Int. Cl.
*H01H 9/00* (2006.01)

(52) U.S. Cl. ..... 200/339

(58) Field of Classification Search ..... 200/339, 200/553, 557, 6 R, 6 C
See application file for complete search history.

(56) References Cited

U.S. PATENT DOCUMENTS

| | | | | |
|---|---|---|---|---|
| 2,109,378 | A * | 2/1938 | Bentley | 200/450 |
| 3,581,033 | A | 5/1971 | Plumb | |
| 3,598,943 | A | 8/1971 | Barrett | |
| 3,641,291 | A | 2/1972 | Carling | |
| 3,772,484 | A | 11/1973 | Roeser | |
| 3,778,577 | A | 12/1973 | Fromknecht et al. | |
| 4,345,121 | A | 8/1982 | Tenner | |
| 4,383,155 | A | 5/1983 | Tenner | |
| 4,401,872 | A | 8/1983 | Boichot-Castagne et al. | |
| 4,686,339 | A | 8/1987 | Sapone | |
| 4,767,895 | A | 8/1988 | Parrish | |
| 4,778,964 | A | 10/1988 | Kamisada | |
| 5,543,595 | A | 8/1996 | Mader et al. | |
| 6,166,344 | A | 12/2000 | Castonguay et al. | |
| 6,259,351 | B1 | 7/2001 | Radosavljevic et al. | |
| 6,420,669 | B1 | 7/2002 | Shenker et al. | |
| 6,891,117 | B1 | 5/2005 | Gouhl et al. | |
| 6,943,309 | B2 | 9/2005 | Huang | |

OTHER PUBLICATIONS

U.S. Appl. No. 11/389,300, Dodal et al.
U.S. Appl. No. 11/389,323, Dodal et al.
U.S. Appl. No. 11/389,309, Dodal et al.
U.S. Appl. No. 11/389,292, Dodal et al.

* cited by examiner

*Primary Examiner*—Neil Abrams
(74) *Attorney, Agent, or Firm*—King & Spalding

(57) ABSTRACT

An electrical device can include a cradle having a plurality of integral cradle support regions. A trough is formed through each cradle support region. Each cradle support region includes an aperture that is configured to receive an actuator assembly. Each actuator assembly is movable to open and close electrical connections in the electrical device when the cradle is installed in the electrical device.

24 Claims, 20 Drawing Sheets

ELECTRICAL DEVICE CRADLE WITH MULTIPLE INTEGRAL SUPPORT REGIONS

CROSS REFERENCE TO RELATED APPLICATIONS

The application is related to the following co-pending applications: U.S. patent application Ser. No. 11/689,323, entitled "Actuator Assembly," filed on Mar. 21, 2007, now U.S. Pat. No. 7,595,460; U.S. patent application Ser. No. 11/689,309, entitled "Toggle Flange," filed on Mar. 21, 2007; U.S. patent application Ser. No. 11/689,300, entitled "Flipper Mechanism," filed on Mar. 21, 2007; and U.S. patent application Ser. No. 11/689,292, entitled "Slip Connection," filed on Mar. 21, 2007, the complete disclosures of which are hereby fully incorporated herein by reference

BACKGROUND

The disclosure relates in general to electrical devices, such as, for example, combination devices.

DETAILED DESCRIPTION

Figure 1:
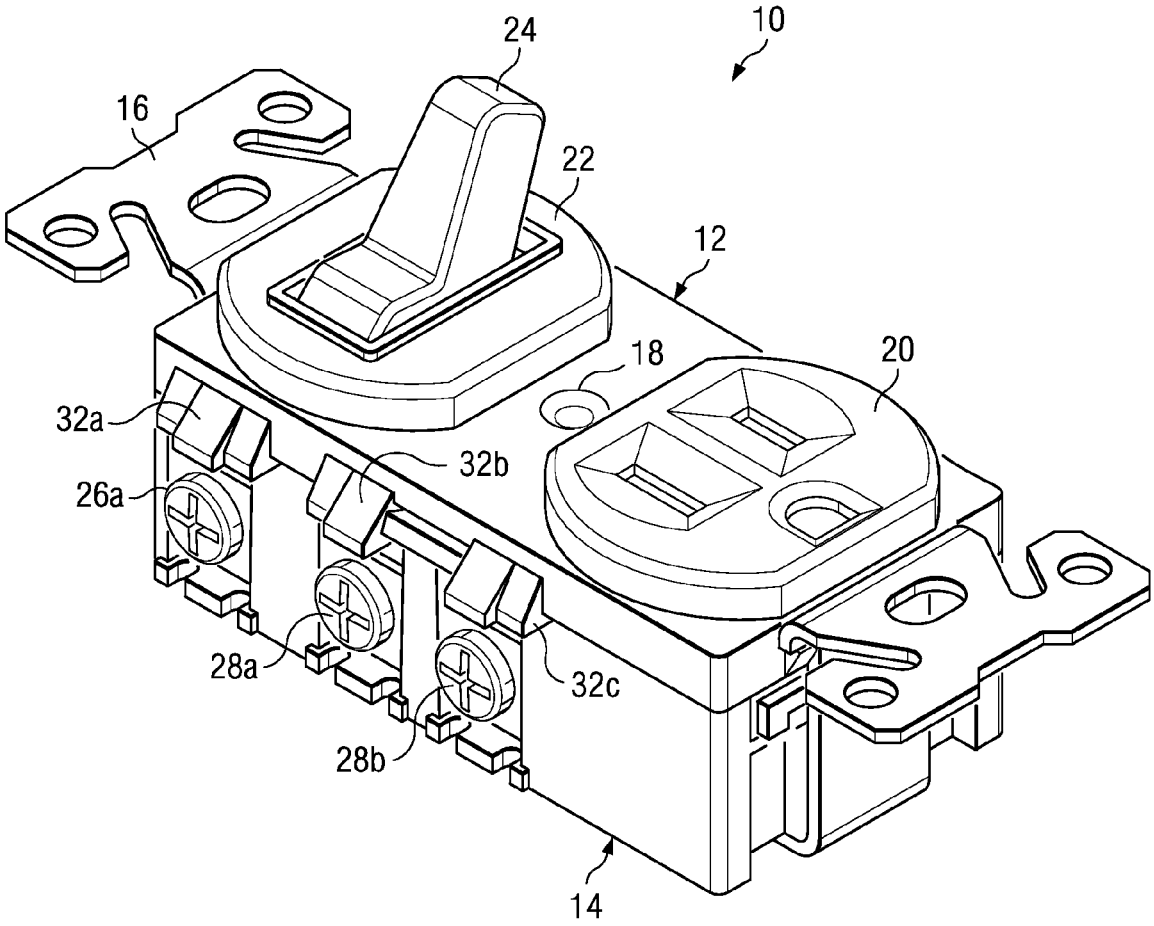
FIG. 1 is an illustration of a perspective view of an exemplary embodiment of a duplex style combination device.

In an exemplary embodiment, as illustrated in FIG. 1, an electrical device is shown as a combination device and generally referred to by the reference numeral 10 and includes a top housing 12 and a bottom housing 14 coupled thereto. A mounting strap 16 extends between or around the top housing 12 and the bottom housing 14 and in some embodiments, assists with coupling the top housing 12 to the bottom housing 14. An opening 18 is formed in the top housing 12 for receiving an assembly screw 19 (FIG. 2) that permits connection of the combination device 10 to a typical wall outlet cover plate (not shown). The top housing 12 further includes a receptacle outlet portion 20 adapted to receive a two-prong or three-prong electrical plug, and includes a switch portion 22 adapted to cooperate with a switching component, such as a toggle 24.

Figure 2:
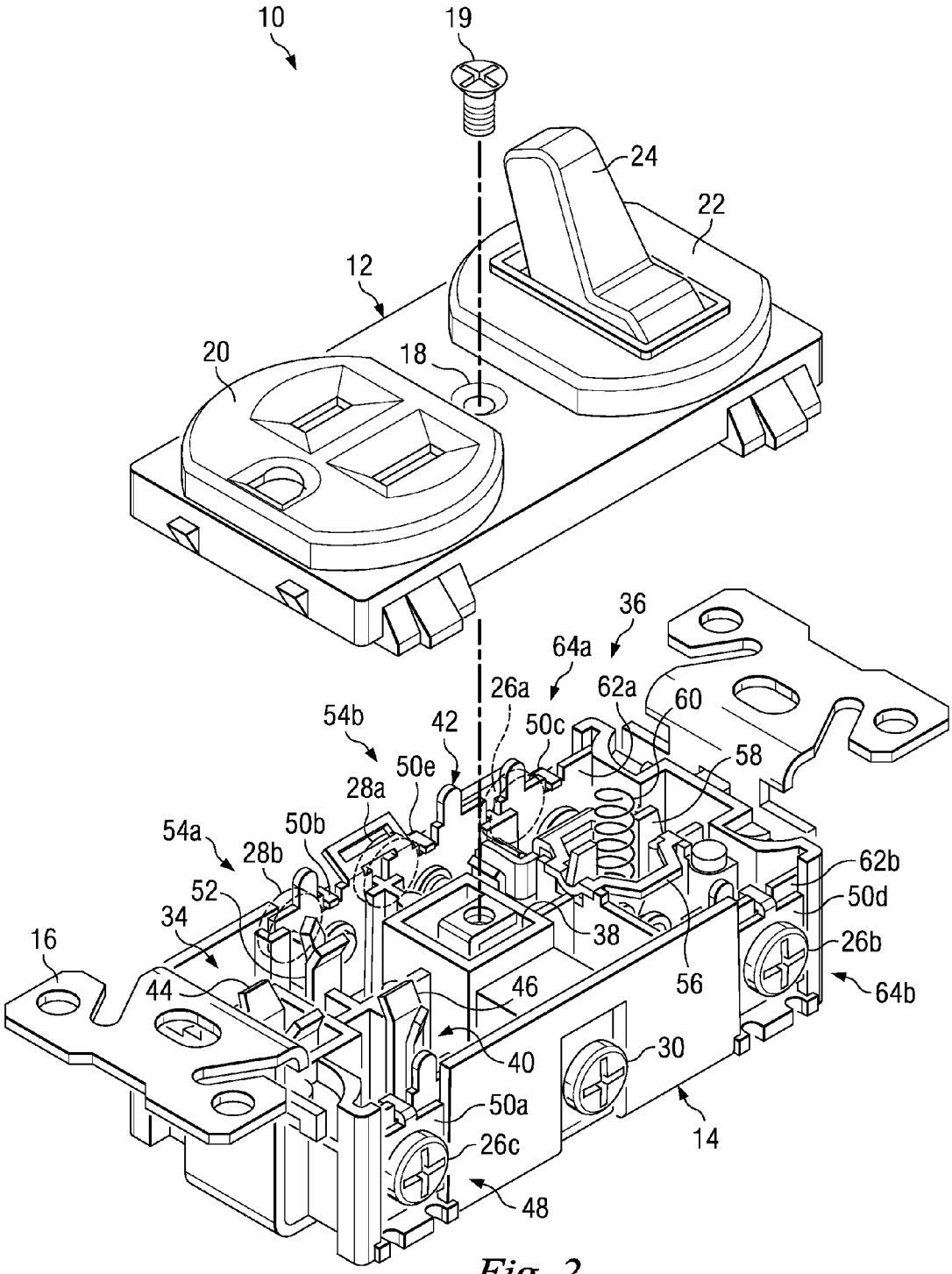
FIG. 2 is an illustration of another perspective view of the device of FIG. 1, with the top housing and toggle removed.

A load terminal screw 26*a* and common terminal screws 28*a* and 28*b* are disposed on a first side of the bottom housing 14. Similar load terminal screws 26*b* and 26*c* are disposed on the opposing side of the bottom housing 14, along with a ground screw 30, as is shown in FIG. 2. Depending upon the desired combination, each of the load terminal screws 26 may be a hot or a neutral terminal screw, and each of the common terminal screws 28 may be a neutral or hot terminal screw. The ground screw 30 is coupled to the mounting strap 16. Guide pockets 32*a*, 32*b*, and 32*c* extend from the top housing 12 over the terminal screws for use when backwiring. Similar guide pockets may be found on the opposing side of the combination device 10.

FIG. 2 shows an exemplary embodiment of the combination device 10 having the top housing 12 and the toggle 24 removed from the bottom housing 14. This may be achieved by disengaging the mounting strap 16 and breaking any ultrasonic welds. Inside the bottom housing 14, components of the combination device 10 are arranged to provide a combination of functionality. In this embodiment, the components are arranged to provide switching through the switch 22 and electrical outlet power through the receptacle outlet 20.

The components of the combination device 10 include receptacle outlet components 34, switch components 36, and an assembly screw bore 38.

Figure 3:
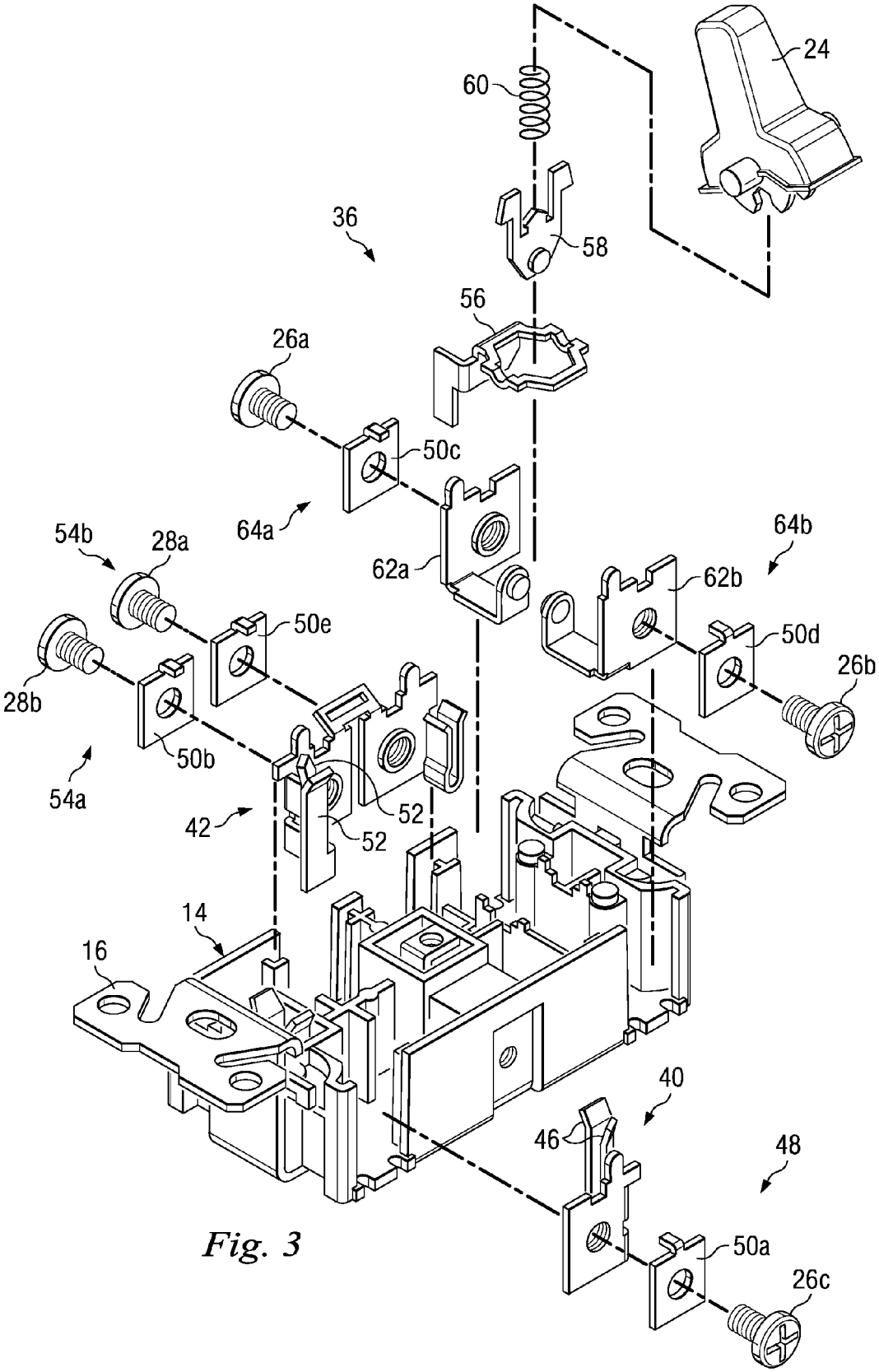
FIG. 3 is an illustration of an exploded view of the device of FIG. 1.

The receptacle outlet and switch components 34, 36 are described with reference to exemplary embodiments shown in FIGS. 2 and 3. FIG. 3 shows the switch components 36 in an exploded view. The receptacle outlet components 34 include a receptacle terminal 40, a common terminal 42, and a ground contact 44. The receptacle terminal 40 includes first receptacle contacts 46 configured to receive a first prong of an electrical plug (not shown) and extends from the first receptacle contacts 46 to a load terminal 48. The load terminal 48 includes the load terminal screw 26*c* threadably engaged with a backwire clamp 50*a* and also threadably engaged with the receptacle terminal 40. The common terminal 42 includes second receptacle contacts 52 configured to receive a second prong of the electrical plug (not shown) and extends from the second receptacle contacts 52 to a common load terminal 54*a* and a common load terminal 54*b*. The common load terminals 54*a*, 54*b* include the common terminal screws 28*b*, 28*a* threadably engaged with backwire clamps 50*b*, 50*e* and with the common terminal 42. The ground contact 44 is configured receive a ground prong of an electrical plug (not shown) and electrically communicates with the mounting strap 16.

The switch components 36 include the toggle 24, common terminal 42, a cradle 56, a flipper 58, a spring 60, and switch terminals 62*a*, 62*b*. Load terminals 64*a*, 64*b*, including backwire clamps 50*c*, 50*d* and the load terminal screws 26*a*, 26*b*, electrically communicate with the switch terminals 62*a*, 62*b*.

Figure 4:
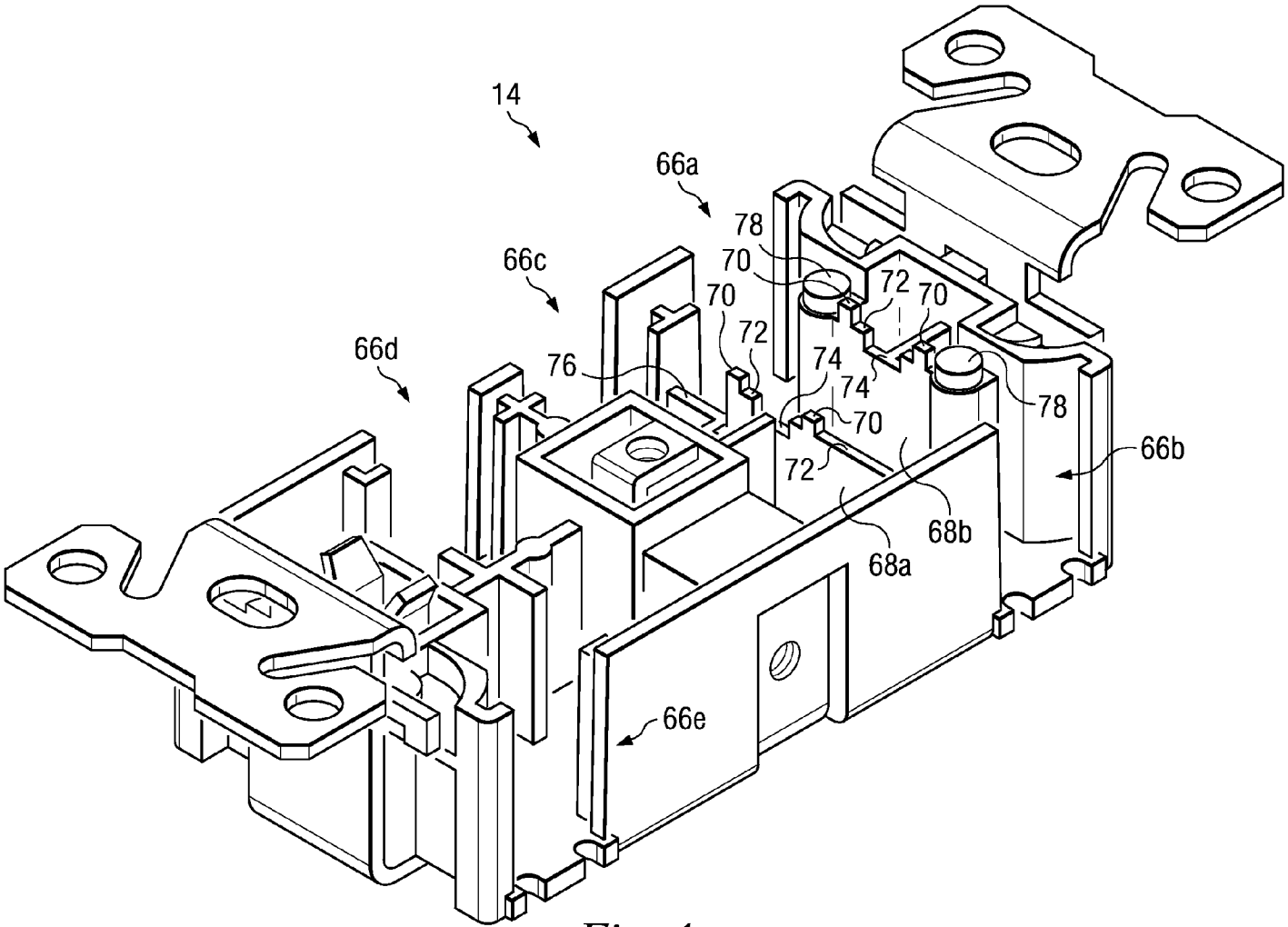
FIG. 4 is an illustration of a perspective view of a bottom housing and mounting strap depicted in FIG. 3.

FIG. 4 shows an exemplary embodiment of the bottom housing 14, which includes a receptacle portion for housing the receptacle outlet components 34 and a switch portion for housing the switch components 36. It also includes a slot 66*a* for the switch terminal 62*a*, slot 66*b* for the switch terminal 62*b*, slots 66*c* and 66*d* for the common terminal 42, and slot 66*e* for the receptacle terminal 40. Transversely extending cradle support posts 68*a*, 68*b*, which in this embodiment appear as walls, are configured to receive and support the cradle 56. These posts include stepped levels forming a cradle boundary level 70, a support level 72, and a receiving level 74. The boundary level 70 is formed to limit longitudinal or transverse movement of the cradle 56 relative to the bottom housing 14. Accordingly, the boundary level 70 is formed to fit adjacent to sides of the cradle 56 and physically block movement of the cradle 56. The support level 72 of the cradle support posts 68*a*, 68*b* interfaces with a bottom side of the cradle 56 when the bottom housing 14 is lying flat, as in the exemplary configuration shown. The receiving level 74 forms a gap in the support level 72. This receiving level 72 receives a downwardly extending U-shaped portion of the cradle 56.

The cradle support post 68*a* includes a low wall 76 forming a gap at one side of the boundary level 70 that allows a portion of the cradle 56 to extend to and interface with the common terminal 42, as is described further below. Adjacent the cradle support post 68*b*, the housing includes a portion formed as rubber bumpers 78 configured to dampen and cushion movement of the toggle 24.

Figure 5:
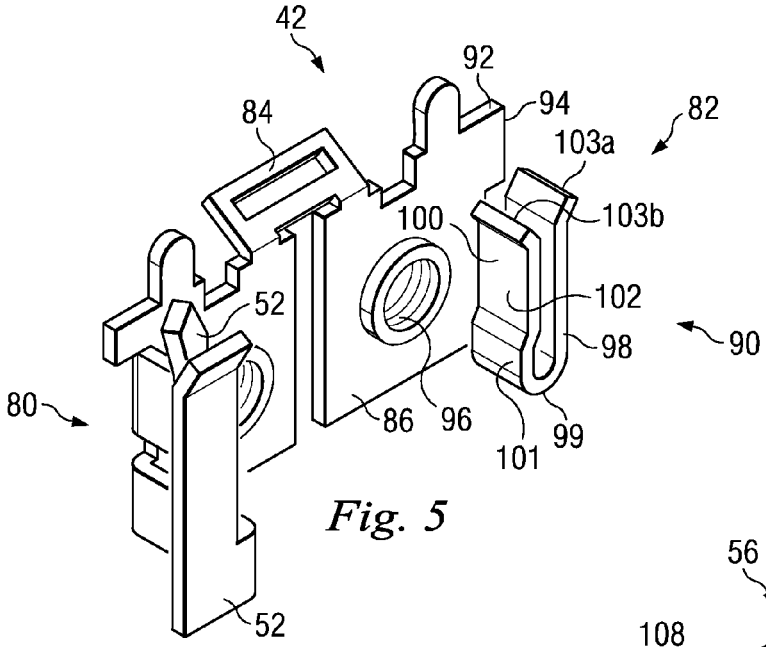
FIG. 5 is an illustration of a perspective view of a common terminal depicted in FIG. 3.

Turning now to FIG. 5, in this exemplary embodiment, the common terminal 42 includes an outlet portion 80 and a switch portion 82. These portions 80, 82 are connected by a break-off tab 84 that allows an installer to customize the combination device 10 to provide a desired functionality. For example, with the break-off tab 84 in place as shown, the receptacle outlet components 34 and the switch components 36 may be optionally wired to electrically communicate to provide selective power to the outlet components 34 through the switch components 36. Other wiring configurations are contemplated. Alternatively, the break-off tab 84 may be removed to isolate the outlet portion 80 and the switch portion 82 of the common terminal 42, thereby isolating the receptacle outlet components 34 from the switch components 36.

The outlet portion 80 includes the second receptacle contacts 52 described above. It should be noted however, that other configurations of the second receptacle contacts 52, as well as the first receptacle contacts 46, are contemplated. The switch portion 82 includes a main wall 86, a slip receiver 90, and a bend (not shown) connecting the main wall and the slip receiver. In this embodiment, the main wall 86, the bend, and the slip receiver 90 are all formed of a single conductive sheet, stamped and formed to create the common terminal 42. The main wall 86 includes an upper edge 92, a side edge 94, and a screw receiving portion 96, such as an aperture or a slot, for receiving the common terminal screw 28*a*. In the embodiment shown, the slip receiver 90 connects to the main wall 86 at the bend and extends at an angle between 70° and 90° from the main wall 86. Accordingly, the bend may form up to a right angle. In other embodiments, other angles both larger and smaller are contemplated. In this embodiment, the main wall side edge 94 extends less than the total height of the main wall 86, with the side edge 94 ending at the bend. The slip receiver 90 is configured to cooperate with the cradle 56 to form a slip connection. In this embodiment, the slip receiver 90 is U-shaped and includes a first wall 98 connected to the bend and a second wall 100 configured to lie adjacent the first wall 98. The first and second walls 98, 100 may be formed of a single plate and bent to form the U-shaped slip receiver 90, thereby forming an integral bridge 99 between the first and second walls 98, 100. Accordingly, the second wall 100 is not attached at its sides to the main wall, but instead connects to the first wall 98 only at the bridge 99. In this embodiment, the second wall 100 is disposed closer to the screw receiving portion 96 than the first wall 98, and the second wall includes a first portion 101 and a second portion 102. The first portion 101 is formed to be substantially parallel to the first wall 98 and is spaced a first distance from the first wall 98. The second portion 102 extends from the first portion 101 and also is substantially parallel to the first wall 98. The second portion 102 is spaced a second distance from the first wall 98, with the distance from the first portion 101 to the first wall 98 being greater than distance from the second portion 102 to the first wall 98. Upper edge portions 103*a*, 103*b* of the first and second walls 98, 100 diverge and are flared to receive a connecting component, such as a portion of the cradle 56, as is described below.

Figure 6:
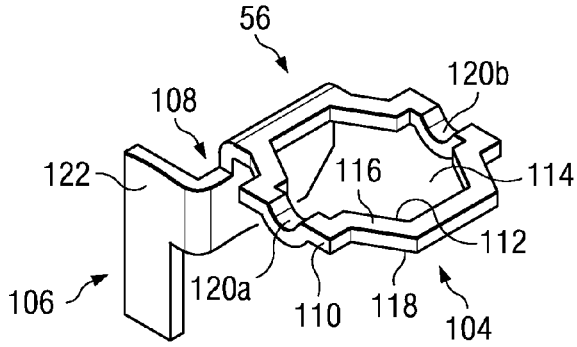
FIG. 6 is an illustration of a perspective view of a cradle depicted in FIG. 3.

An exemplary embodiment of the cradle 56 is shown in greater detail in FIG. 6. The cradle 56 includes a ring-like body portion 104 and a connecting portion 106. A transition portion 108 connects the body and connecting portions 104, 106. The body portion 104 includes an outer perimeter edge 110, an inner edge 112 defining a central aperture 114, and upper and lower surfaces 116, 118. The body portion 104 is formed to include a plurality of U-shaped troughs 120*a*, 120*b* on opposing sides of the central aperture 114. The cradle 56 is configured to fit within the bottom housing 14 so that the U-shaped troughs 120 fit within the receiving levels 74 (FIG. 4), at least a portion of the lower surface 118 is configured to rest on the support level 72 (FIG. 4), and the outer perimeter edge 110 lies adjacent the boundary level 70 (FIG. 4).

The connecting portion 106 is a plate-like, rectangular-shaped conductor configured to interface with the common terminal 42. It extends downwardly, well below the level of the body portion 104, so that it extends away from the body portion 104 and the transition portion 108. The transition portion 108 extends from an upper portion 122 of the connecting portion 106 to one side of the body portion 104. When in the bottom housing 14, the transition portion 108 extends through the gap formed over the low wall 76 in the cradle support post 68*a* (FIG. 4).

Figure 7:
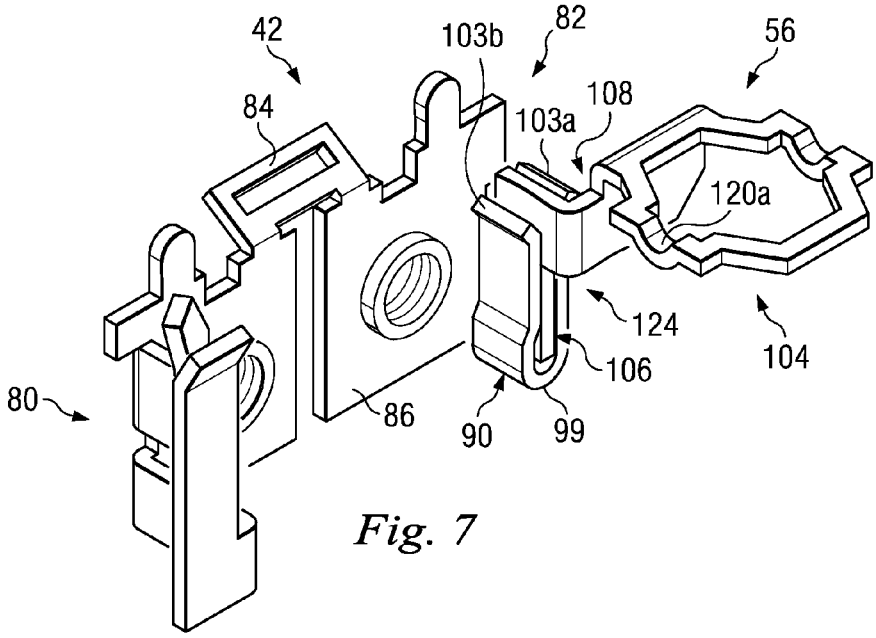
FIG. 7 is an illustration of a perspective view of a joined cradle and common terminal depicted in FIG. 3.

FIG. 7 shows an exemplary embodiment of the common terminal 42 connected to the cradle 56 to form a slip connection 124. In this embodiment, the connecting portion 106 is introduced into the top portion of the slip receiver 90, between the diverging upper edge portions 103*a*, 103*b*. As the connecting portion 90 is introduced, the first and second walls 98, 100 may be formed to elastically deform to separate and receive the connecting portion 106. Thus, the first and second walls 98, 100 may be configured to apply an elastic returning force against the connecting portion 106, thereby maintaining electrical contact with the connecting portion 106.

Inserting the connecting portion 106 within the U-shaped slip receiver 90 provides electrical communication between the common terminal 42 and the cradle 56. This arrangement allows displacement of the connecting portion 106 relative to the common terminal 42, while still maintaining the electrical connection. The connecting portion 106 can be moved in any direction along its plane relative to the slip receiver 90, including longitudinally and laterally. Because the connection is not fixed, the cradle 56 may be oriented and manipulated to fit properly within the outer housing 14 on the cradle support posts 68 while still maintaining a solid mechanical and electrical joint with the common terminal 42. This also gives leverage to adjust the cradle 56 in the bottom housing 14.

In other embodiments, the common terminal includes the connecting portion and the cradle includes the slip receiver. In some such embodiments, the slip receiver may be flipped so that the receiving portion is introduced into the slip receiver from a bottom portion, rather than from a top portion, as described. Other arrangements are contemplated.

Figure 8:
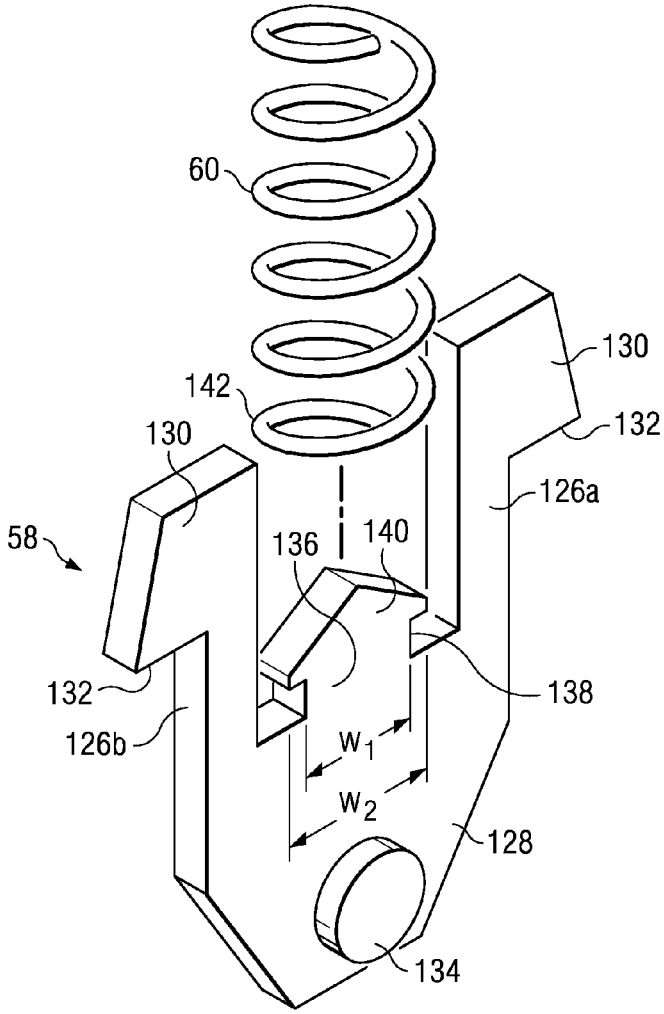
FIG. 8 is an illustration of a perspective view of a flipper and spring depicted in FIG. 3.

FIG. 8 shows exemplary embodiments of the flipper 58 and spring 60. The flipper 58 is U-shaped having arms 126*a*, 126*b* connected by a bridge 128. The arms 126 include oppositely protruding engagement elements 130 having lower cradle interfacing edges 132. The flipper 58 may be sized to fit through the central aperture 114 of the cradle 56, while the protruding engagement elements 130 fit into the U-shaped troughs 120 in the cradle body portion 104. Accordingly, the cradle interfacing edges 132 of the flipper 58 physically engage and electrically communicate with the upper surface 116 of the U-shaped troughs 120 of the cradle 56.

The bridge 128 includes a centrally disposed electrical contact 134. It extends through the bridge 128 and is configured to make an electrical connection on either the front side of the flipper 58 or the opposing back side (not shown). In the embodiment shown, the electrical contact 134 is a double-sided silver contact rivet. The bridge 128 includes a spring interface portion 136 protruding upwardly between the arms 126. The spring interface portion 136 has a width W1 at a base 138 and a width W2 at a central region 140. The flipper is configured to rock within the cradle to move into and out of contact with the switch terminals 62*a*, 62*b*. This is explained in greater detail below.

The spring 60 interfaces with the flipper 58 and the toggle 24. One end 142 attaches over the spring interface portion 136. The spring 60 has a diameter that elastically deforms to fit over the central region 140 and that fits closely over the base 138. Accordingly, the spring 60 may be placed over the spring interface portion 136 during assembly and held in place by the central region 140 by interference.

Figure 9:
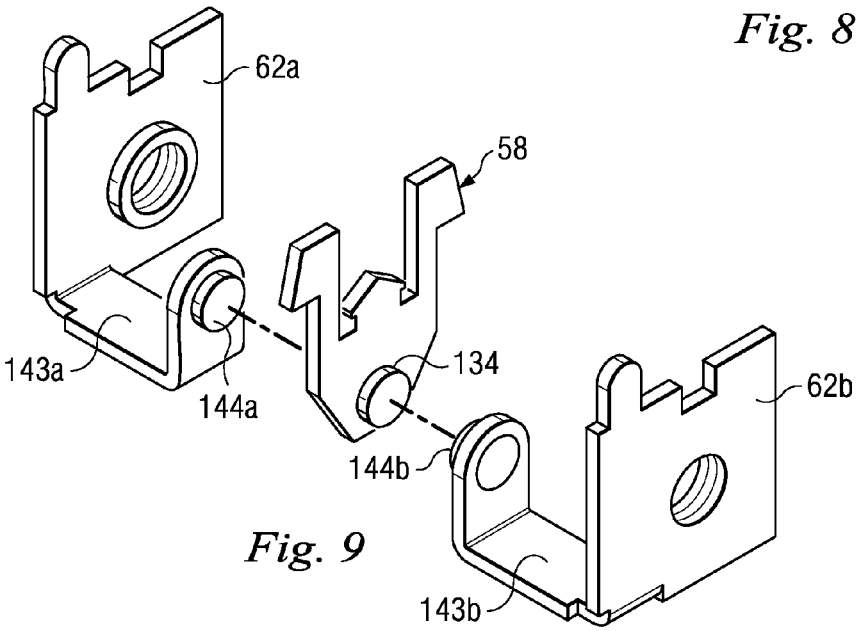
FIG. 9 is an illustration of a perspective view of the flipper and contact terminals depicted in FIG. 3.

FIG. 9 shows an exemplary embodiment of the flipper 58 relative to the switch terminals 62*a*, 62*b*. The switch terminals each include an arm 143*a-b* supporting an electrical contact portion 144*a-b*. This contact portion 144 is arranged selective electrical contact with the electrical contact 134 of the flipper 58. The flipper 58 is configured to rock back forth, as controlled by the toggle 24 and spring 60, to make selective contact with either the electrical contact portion 144*a* or electrical contact portion 144*b*. In some embodiments, the arm 143 is configured differently than shown. For example, in the embodiment shown, the arm 143 is configured to extend flat along the bottom housing 14. In other exemplary embodiments, the arm 143 is configured to be perpendicular to that shown, so that the contact portion 144 is located substantially as shown, but the supporting arm 143 extends at a side of the contact portion 144.

One exemplary embodiment of the toggle 24 is described with reference to FIGS. 10-14. The toggle 24 includes a lever portion 150, a base portion 152, and switching elements 154. The lever portion 150 and at least part of the base portion 152 protrude upwardly out of the top housing 12, as shown in FIG. 1. The base portion 152 is relatively rectangular in shape, having two relatively long sides 156*a-b* and two relatively short sides 158*a-b*.

Figure 10A:
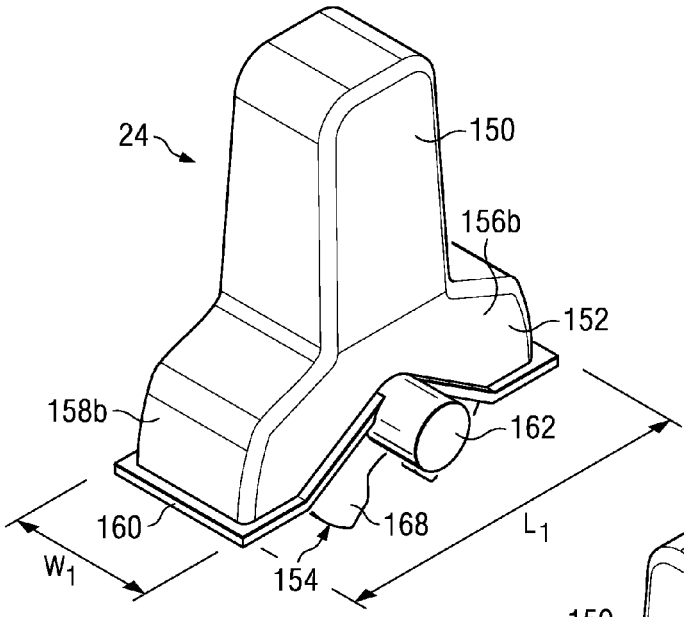
FIGS. 10A and 10B are illustrations of perspective views of an exemplary toggle.

A flange 160 protrudes outwardly from the relatively long and short sides 156, 158. This flange 160 is configured to cooperate with the top housing 12 to restrict or limit visibility into the housing so that any arcing and sparking within the housing is less visible to a person flipping the toggle 24. The flange 160 protrudes outwardly from a bottom edge 159 (FIG. 11) of each of the long and short sides 156, 158. On each of the long sides 156*a-b*, the flange 160 extends along the bottom edge 159 for only a portion of the length of the side 156*a-b*. The flange 160 increases the overall width and length of the base portion 152 of the toggle 24. Referring to FIG. 10A, the toggle 24, with the flange 160 is formed to have a width W1 and a length L1.

The switching elements 154 interface with the top housing 12 and the switch components 36 to operate the switch 22. The switching elements 154 include pivot pins 162, a rotation limiter 164 having stop surfaces 166, side wall portions 168, and a protruding spring interface portion 170. The side wall portions 168 extend generally within a same plane as the long sides 156 of the base portion 152, along opposing sides of the spring interface portion 170. A cutout 172, extending toward the lever portion 150, is included in the side wall portions 168 and is sized to receive at least a portion of the arms 126 of the flipper 58.

The pivot pins 162 extend outwardly from the side wall portions. The pivot pins 162 are cylindrical protrusions extending from opposing sides of the toggle 24 and are configured to interface with the top housing 12 to pivotally secure the toggle 24 in its operative position. The rotation limiter 164 extends on either side of one of the pivot pins 162, and the stop surface 166 is configured to interface with the rubber bumpers 78 in the bottom housing to limit the amount of rotation of the toggle 24.

The spring interface portion 170 protrudes out of the base portion 152 away from the lever portion 150 and is configured to interface with an end 174 of the spring 60. The spring interface portion includes a center protrusion 176 and a shoulder portion 178. The end 174 of the spring 60 extends around the center protrusion 176 and rests on the shoulder portion 178. Reinforcement portions 180 extend along at least a part of the spring interface portion.

Figure 10B:
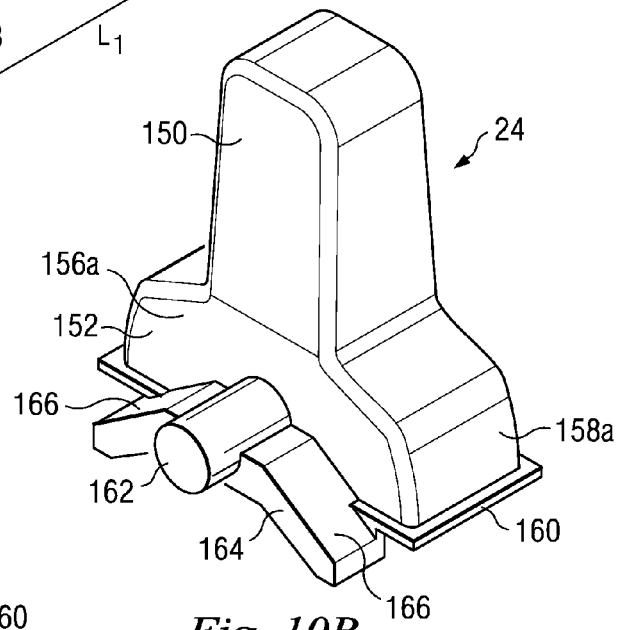
Figure 11:
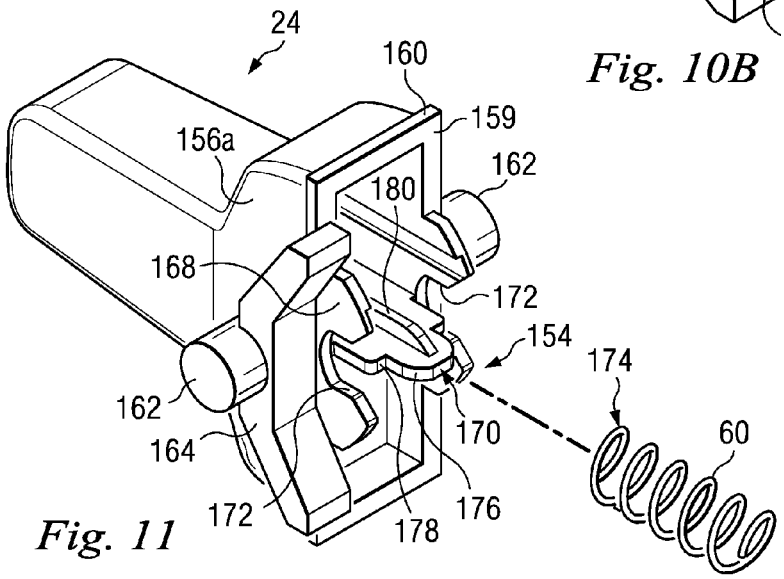
FIG. 11 is another illustration of a perspective view of the toggle depicted in FIGS. 10A and 10B with a spring.

As best seen in the exemplary embodiment in FIG. 10B, the flange 160 protrudes up to and ends at the rotation limiter 164 along one long side 156*a*, and as best seen in FIG. 10A, the flange 160 includes a first portion extending along the bottom edge 159 of the long side 156*b* and a second portion that angles from the bottom edge 159 of the base portion 152 toward the lever 150 to the pivot pin 162. This flange 160, in cooperation with the rotation limiter 164, as explained above, acts as the shield to limit the visibility of arcing that may occur within the combination device 10 as the switch is flipped.

Figure 12:
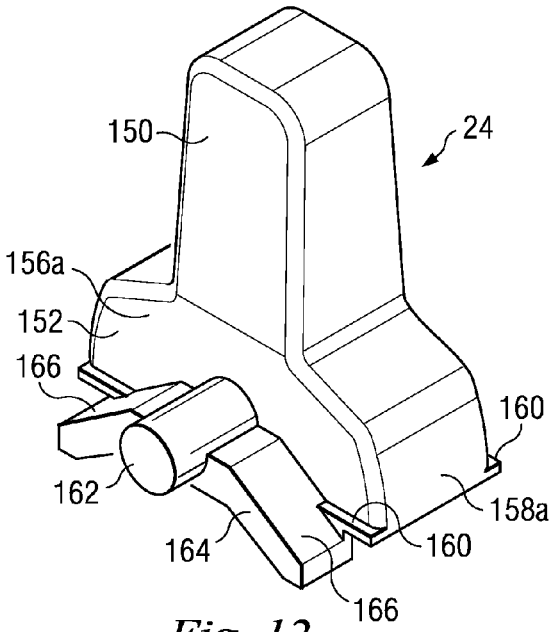
FIG. 12 is an illustration of a perspective view of another exemplary toggle.

FIG. 12 shows another exemplary embodiment of the toggle 24. In this exemplary embodiment, the toggle 24 may be formed to include any or all of the features described above, but in this case, the flange 160 extends along only the two relatively long sides 156*a-b* of the base portion 152. Accordingly, in this exemplary embodiment, the flange 160 increases the overall minimum width of the toggle 24, but does not increase the overall length. The flange 160 in FIG. 12 may include any of the features described above, but is shown as not extending along the relatively short sides 158*a-b*.

Figure 13:
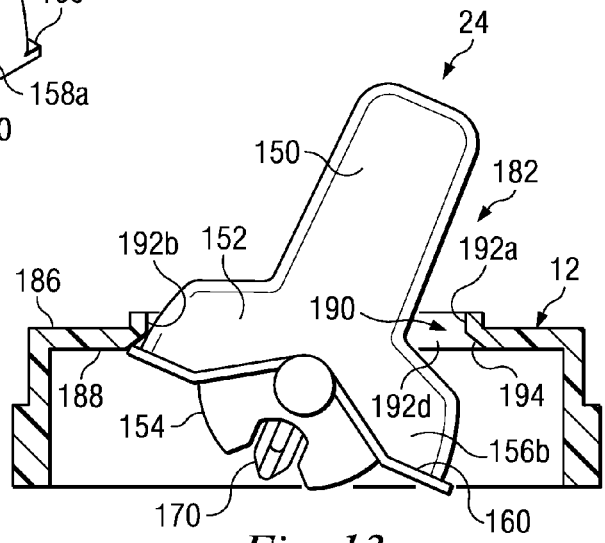
FIG. 13 is an illustration of a cross-sectional view of the upper housing depicted in FIG. 2 and the toggle depicted in FIG. 3.
Figure 14:
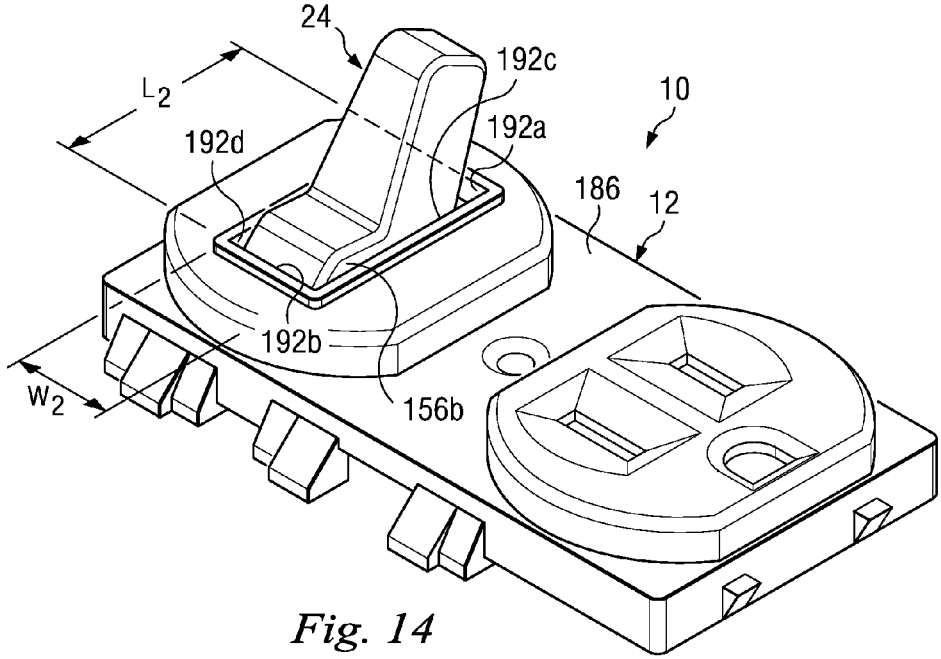
FIG. 14 is an illustration of the upper housing depicted in FIG. 2 and the toggle depicted in FIGS. 10A and 10B.

FIGS. 13 and 14 show examples of the flange 160 in operation to limit or block a user's view into the combination device 10 through a toggle aperture 182 in the top housing 12. In FIG. 13, the top housing 12 is shown in cross-section and includes the toggle aperture 182. In FIG. 14, the top housing 12 is shown with the toggle 24 in an isometric view. Referring to both FIGS. 13 and 14, the top housing 12 includes a top surface 186, a bottom surface 188, and an aperture wall 190 that defines the toggle aperture 182. As best seen in FIG. 14, the aperture wall 190 includes faces 192*a-d*, with two of the aperture faces 192*a*, 192*b* being relatively shorter and two of the aperture faces 192*c*, 192*d* being relatively longer. The longer faces 192*c*, 192*d* have a length L2 and the shorter faces have a width W2.

In the exemplary embodiment shown in FIG. 13, the shorter inner faces 192*a*, 192*b* are chamfered where the faces 192*a*, 192*b* meet with the bottom surface 188 of the top housing 12. These chamfers create an interfacing surface 194 that cooperates with the flange 160 to limit the visibility to the interior of the combination device 10. In other embodiments, the faces 192 and the bottom surface 188 form a substantially right angle, without a chamfer. Other embodiments are contemplated.

In use, the toggle 24 is inserted through the toggle aperture 182 in a manner to limit the visibility through the toggle aperture 182. When flipped, the toggle 24 pivots about the pivot pins 162, which are secured relative to the top housing 12, until the rotation limiter 164 stops the movement of the toggle 24. During rotation, the flange 160 moves to interface with the interfacing surface 194 of the top housing 12. In some embodiments, the flange 160 comes into contact with the top housing 12, while in other embodiments, it is disposed not in contact with the top housing 12, but still limits visibility into the top housing 12 between the toggle 24 and the top housing 12.

Along the long sides 156 of the toggle 24, the flange 160 need not interface directly with the top housing 12 to limit visibility into the combination device 10, but its location along the toggle 24 at least partially blocks the view into the housing 12 along the toggle long side 156. This occurs because the aperture length L2 and the aperture width W2 are less than the toggle length L1 and width W1. In embodiments employing the exemplary toggle in FIG. 12, the aperture width W2 is less than the toggle width W1 to block visibility between the top housing 12 and the base portion 152 along the long side 156*a-b*. Limiting visibility may continue even when the toggle is flipped. Thus, as can be seen in FIGS. 13 and 14, because of the relative sizes, the top housing 12 overlaps the flange 160 to limit visibility through the aperture 182. As shown in FIG. 14, the flange 160 extending about the perimeter of the toggle 24 limits visibility into the combination device along at least one, two, three, or all four sides of the toggle 24.

Figure 15A:
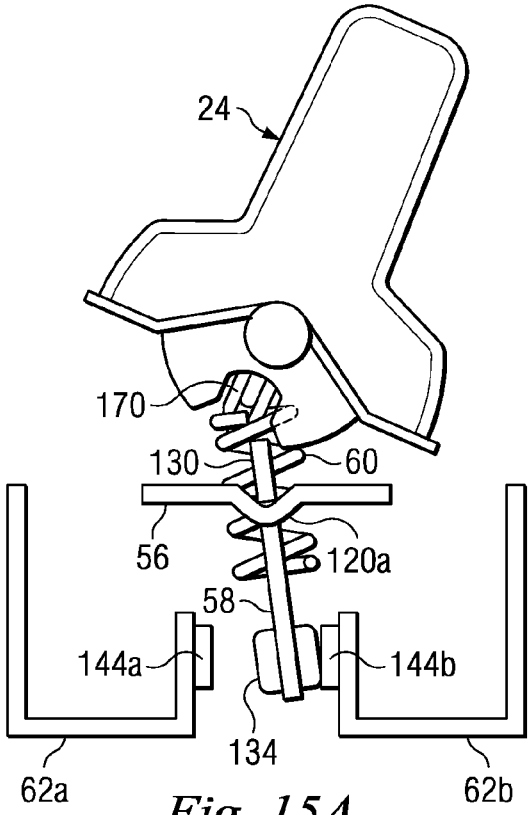
FIGS. 15A and 15B are illustrations of the flipper mechanism in alternate contact positions.
Figure 15B:
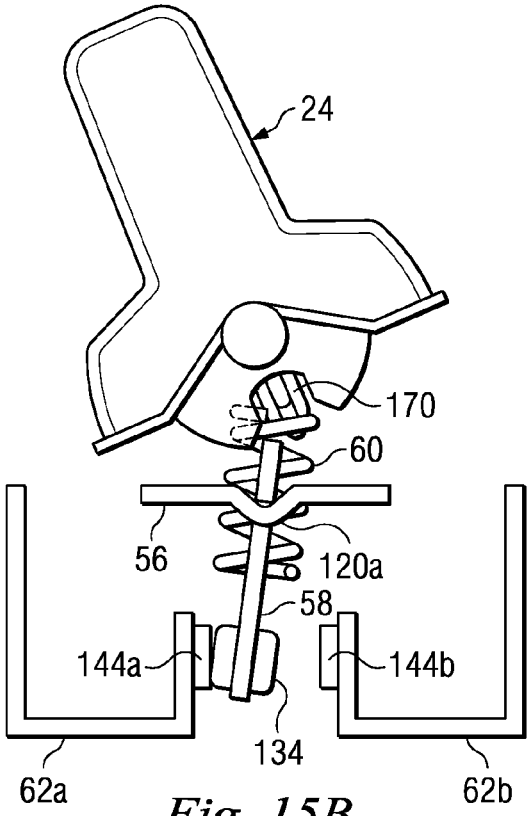

FIGS. 15A and 15B show examples of portions of the exemplary combination device 10 in operation. The combination device 10 may be wired using methods known in the art, and current may be introduced to one or more of the terminals, such as the switch terminal 62*b*. As can be seen in these side views, the flipper 58 rests in the U-shaped troughs 120 of the cradle 56. The spring 60 extends from between the flipper arms 126 to the spring interface portion 170 of the toggle 24. When the toggle 24 is flipped to the right position, as shown in FIG. 15A, the spring interface portion 170 dislocates and flexes the spring 60 so that its spring force moves the flipper 58 to the right. The flipper contact 134 touches and electrically connects with the right switch terminal 62*b*, electrically connecting the right switch terminal 62*b* to the common terminal 42 through the flipper 58 and the cradle 56.

When the toggle 24 is moved to the left as shown in FIG. 15B, the spring 60 dislocates and flexes to apply its spring force against the flipper 58 to move the flipper 58 into contact with the left switch terminal 62*a*, thereby isolating the right switch terminal 62*b* and electrically connecting the left switch terminal 62*a* with the common terminal 42 as explained above.

The combination device 10 may be assembled by sliding the common terminal 42 into the bottom housing 14 so that the outlet portion 80 of the common terminal 42 is in the outlet portion of the bottom housing 14 and the switch portion 82 of the common terminal 42 is in the switch portion of the bottom housing 14. The switch terminals 62*a*, 62*b* and the receptacle terminal 40 also may be inserted into the bottom housing 14 in their proper locations. The cradle 56 may then be introduced to the bottom housing 14 so that it rests on the cradle support posts 68. The cradle troughs 120 may be disposed within the receiving levels of the cradle support posts 68. The boundary levels 70 of the cradle support posts 68 assist by restricting lateral or longitudinal movement of the cradle 56 relative to the bottom housing 14. While inserting the cradle 56, the connecting portion 106 may be inserted into a top of the slip receiver 90 on the common terminal 42. This provides a secure, reliable electrical connection between the cradle 56 and the common terminal 42, but also allows the cradle 56 to be manipulated independently of the common terminal 42. Therefore, the cradle 56 may be manipulated to fit as desired relative to the cradle support posts 68 without affecting the position of the common terminal 42. This may help achieve better fits and may provide more reliability and consistency for flipper operation as it is partially dependent upon the fit of the cradle 56.

Once the cradle 56 is properly placed and connected to the common terminal 42, the spring 60 is placed over the spring interfacing portion 136 of the flipper 58. Because the spring interfacing portion 136 includes a central region 140 that is wider than the base region 138, the spring 60 may elastically deform to fit over the central region 140. The spring 60 and flipper 58 are then introduced through the central aperture 114 of the cradle 56 so that the flipper 58 is suspended by its arms, of which the cradle interfacing edges of the flipper 58 are disposed within the troughs 120. This provides the flipper 58 with the capability to rock back and forth to come into and out of contact with the switch terminals 62*a*, 62*b*.

The toggle 24 may then be placed within the upper housing 12 and the upper housing 12 and the toggle 24 may then be introduced to the bottom housing 14. During this process, the spring interface portion 170 of the toggle 24 is oriented to interface with the spring 60. Doing so, the center protrusion 176 of the spring interface portion 170 extends into the coil spring 60 and the shoulder portion 178 contacts and supports the spring 60. As the top housing 12 and toggle 24 are brought closer to the bottom housing 14, the spring 60 compresses, providing a spring force against the flipper 58 and the toggle 24. Once the top housing 12 is in place, the mounting strap 16, or other system, may be used to securely couple the top and bottom housings 12, 14 together. The terminal screws and backwire clamps may be attached at any time throughout the process.

In several exemplary embodiments, instead of, or in addition to the exemplary electrical devices shown, the electrical devices disclosed herein may be in the form of, and/or include, a wide variety of electrical devices and/or combinations thereof, including, for example, a wide variety of wiring devices, a wide variety of combination devices, a wide variety of duplex-style combination devices, a wide variety of decorator-style combination devices, one or more nightlights, one or more single-pole switches, one or more receptacle outlets, one or more dimmers, one or more three-way switches, one or more single-pole double combination switches, one or more single-pole triple combination switches, pilot lights, and other receptacles, and/or any combination thereof.

FIGS. 16-23B show another exemplary embodiment of an electrical device as a combination device generally referred to by the reference numeral 200. This combination device 200 is a decorator style combination device including two switches. Again, as explained above the principles applied to the combination device 200 may be equally applicable to other types of combination devices and such uses are contemplated. In addition, some of the components in the combination device 200 are similar to components in the combination device 10. Description of those components above may be equally applied to components in the combination device 200, and to reduce repetition, is not all repeated again.

Figure 16:
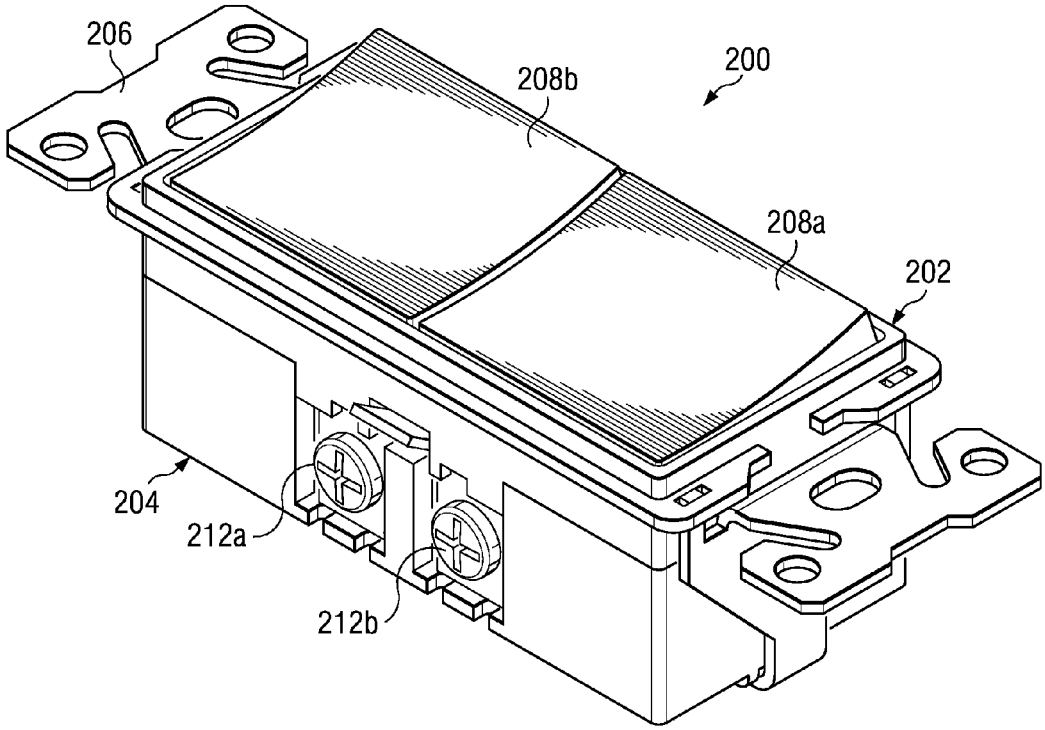
FIG. 16 is an illustration of a perspective view of an exemplary embodiment of a decorator style combination device.

In an exemplary embodiment, the combination device 200 in FIG. 16 includes a top housing 202, a bottom housing 204, and a mounting strap 206. The top housing 202 includes two switching components, which in this embodiment are paddles 208 operable as switches to electrically connect and disconnect electrical lines. Load terminal screws 210*a-b* (FIG. 17) and common terminal screws 212*a-b* are disposed in the bottom housing 204.

Figure 17:
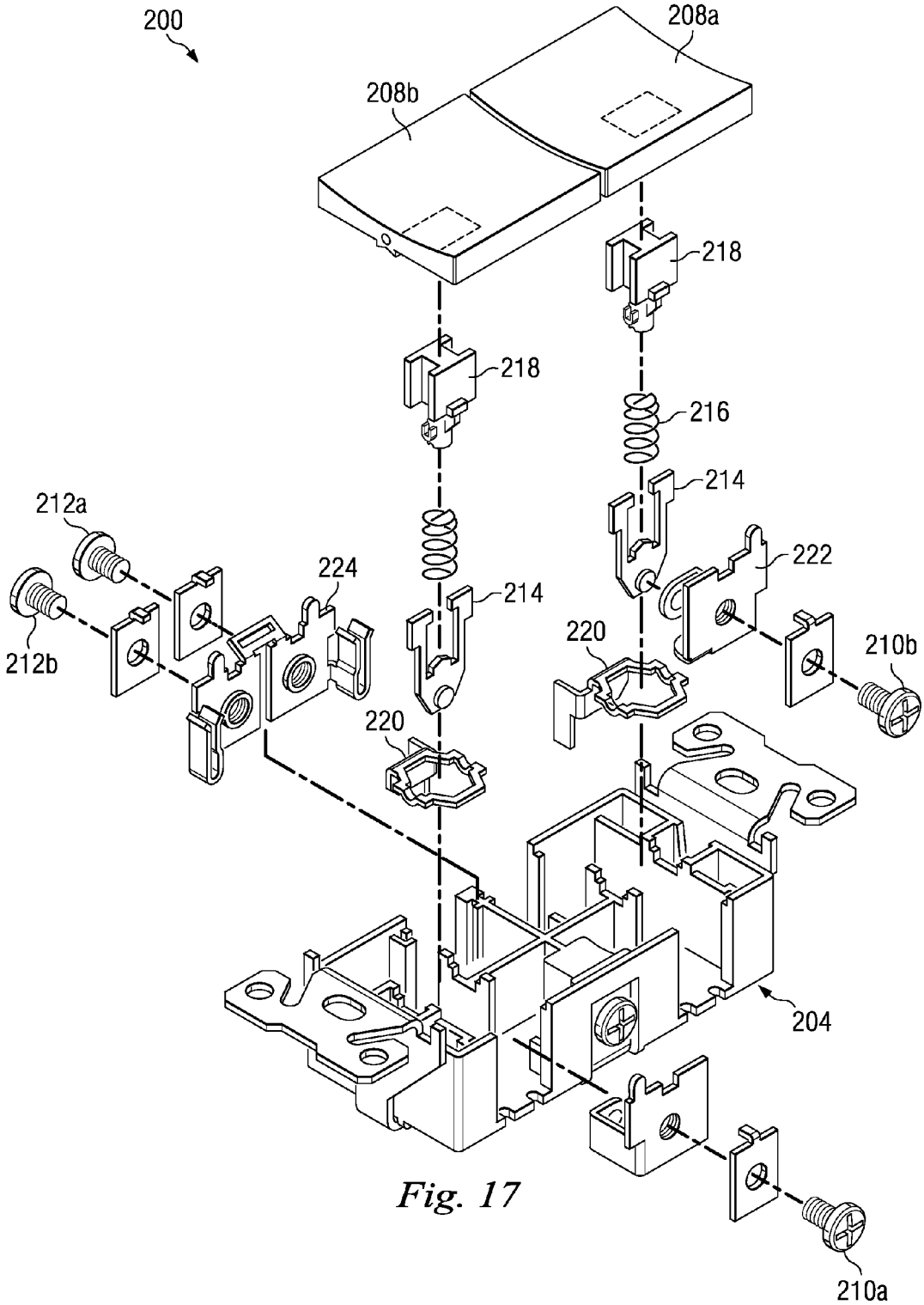
FIG. 17 is an illustration of an exploded perspective view of some of the components of the device of FIG. 16.

According to an exemplary embodiment, FIG. 17 shows portions of the combination device 200 in an exploded form. Although two sets of switching components are shown, only one set is described in detail. The combination device 200 includes the paddle 208*a*, a flipper 214, a spring 216, an actuator 218, a cradle 220, and a switch terminal 222. A common terminal 224 is also included. In many respects, the common terminal 224 is similar to the common terminal described above. However, the slip terminal may be angled differently and may be formed so that the arm supported only by the bridge is disposed further from the screw receiving aperture than the arm connected to the main wall.

Figure 18:
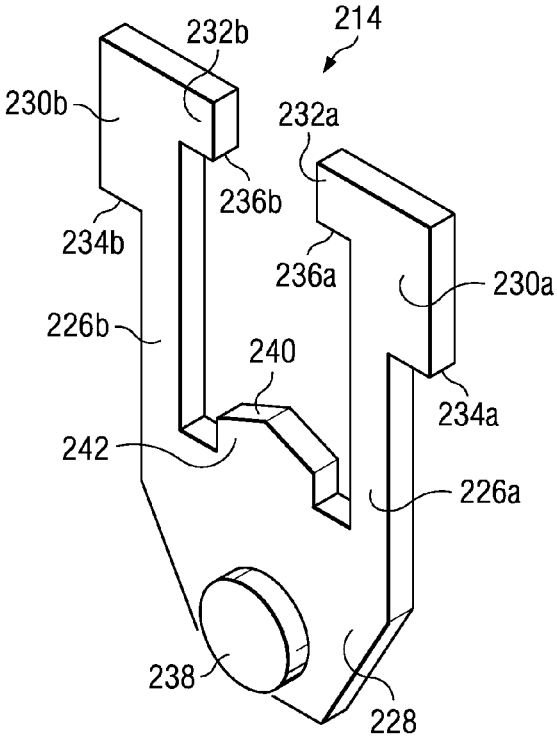
FIG. 18 is an illustration of a perspective view of a flipper depicted in FIG. 17.

An exemplary embodiment of the flipper 214 is shown in greater detail in FIG. 18. The flipper 214 includes arms 226*a*, 226*b* connected to each other at one end by a bridge portion 228. The arms 226 extend relatively parallel and are substantially mirror images of each other. Each arm 226 includes an outwardly extending first engagement element 230 and an inwardly extending second engagement element 232. The first engagement element 230 includes a lower cradle interfacing edge 234 and the second engagement element includes an actuator interfacing edge 236. The bridge portion 228 includes an electrical contact portion 238 riveted there through. In this embodiment, the contact portion 238 is a silver contact formed on only a single side of the flipper 214. However, in other embodiments, the flipper includes a contact disposed on both sides. A spring engaging interface 240 extends upwardly from the bridge portion 228 between the arms 226. In this embodiment, the spring engaging interface is a rounded protrusion having a base 242 smaller than in inner diameter of the spring 216.

Figure 19:
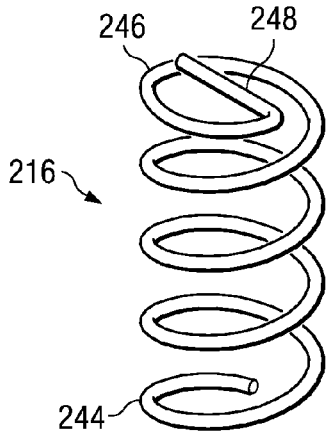
FIG. 19 is an illustration of a perspective view of a spring depicted in FIG. 17.

An exemplary embodiment of the spring 216 is shown in FIG. 19. In this embodiment the spring includes a first end 244 configured to receive the spring engaging interface 240 of the flipper 214 and includes a second end 246 configured to engage with the actuator 218. The second end 246 includes a cross-wire 248 extending across the diameter in a direction transverse to the longitudinally extending spring 216.

Figure 20:
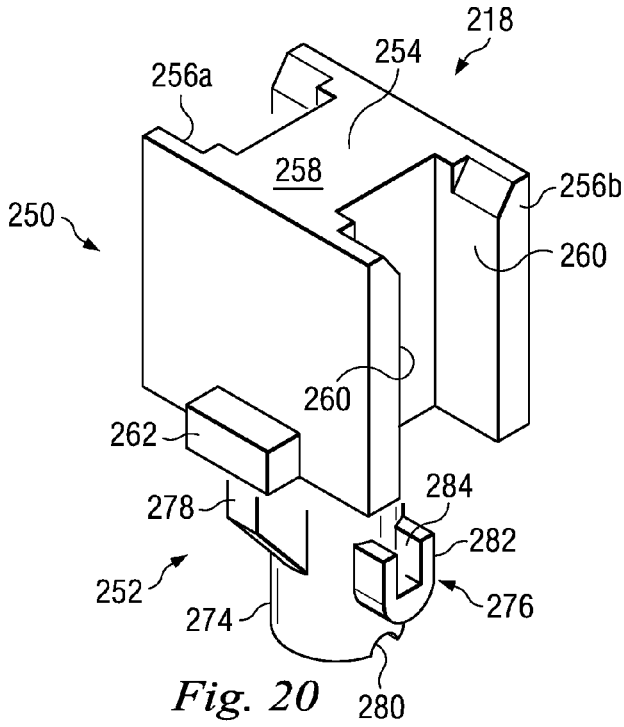
FIG. 20 is an illustration of a perspective view of an actuator depicted in FIG. 17.

FIG. 20 shows an exemplary embodiment of the actuator 218 in greater detail. The actuator 218 includes a paddle end 250 and a switch component end 252. The paddle end 250 includes an H-shaped body having a cross member 254 connecting two substantially rectangular outer walls 256*a*, 256*b*. The paddle end 250 includes an upper outer surface 258. The outer walls 256 have a tapering portion extending from the upper outer surface 258 to inner surfaces 260. The inner surfaces 260 meet the walls of the cross-member 254. A fixation block 262 protrudes outwardly from the outer walls 256. This fixation block 262 cooperates with features on the paddle 208*a* to limit movement of the actuator 218 when it is engaged with the paddle 208*a*.

Figure 21:
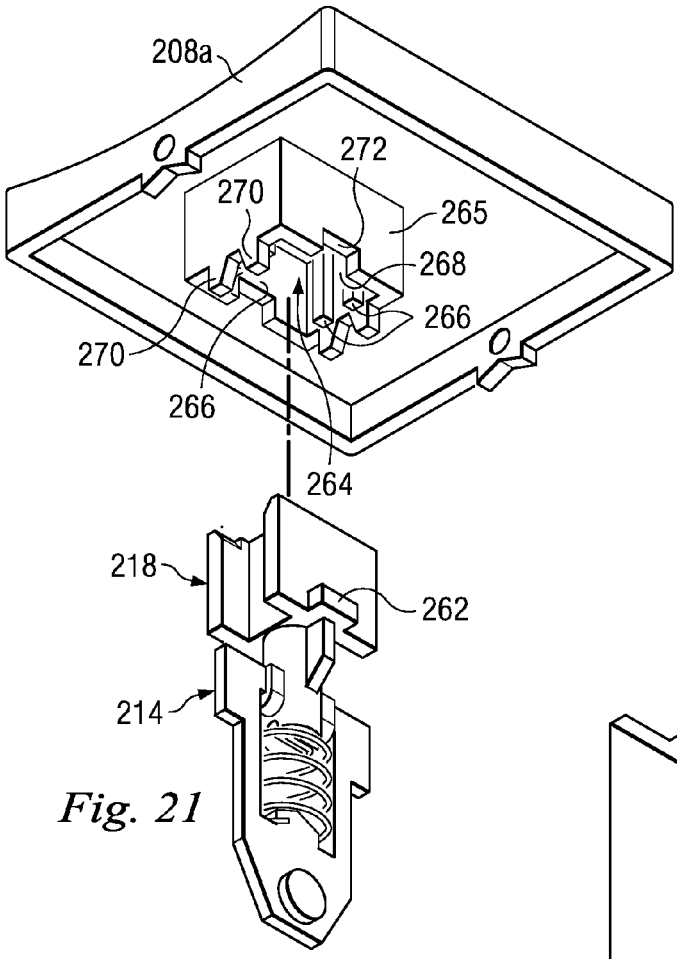
FIG. 21 is an illustration of a perspective view of the actuator of FIG. 20 and a paddle.

According to one exemplary embodiment, FIG. 21 shows the actuator 218 being introduced to the paddle 208*a*. Referring to FIG. 21, the paddle 208*a* includes an actuator receiving bore 264. The bore 264 is formed of a wall 265 having a rectangular inner surface 266 sized to fit about the H-shaped paddle end 250 of the actuator. Beams 268 protrude inwardly from the inner surface 266, forming receiving notches 268. At each end of the of the bore 264, posts 270 protrude from the wall 265, forming a V-shaped cut-out between the posts 270 for interacting and operating the switch, as explained further below.

The actuator paddle end 250 fits into the bore 264. Edges of the actuator outer walls 256 fit into the receiving notches 268 to securely hold the actuator 218 from lateral movement relative to the paddle 208*a*. The fixation block 262 fits into an appropriately shaped cutout 272 in the bore walls 265.

Returning now to the exemplary embodiment of FIG. 20, the switch component end 252 of the actuator 218 includes a relatively cylindrical element 274 having a flipper engagement connection 276, a reinforcement member 278, and a spring-receiving notch 280. The flipper engagement connection 276 includes two substantially similar projecting U-shaped wall portions 282 disposed on opposing sides of the cylindrical element 274. The wall portions 282 form open ends 284 extending toward the actuator paddle end 250.

The spring receiving notch 280 is sized to receive the cross-wire 248 of the spring 216. Likewise, the spring 216 and the cylindrical element 274 are sized so that the spring end 246 extends about the exterior of the cylindrical element 274. Movement of the spring longitudinally along the cylinder is limited by the cross-wire 248 in the spring receiving notch 280.

Figure 22:
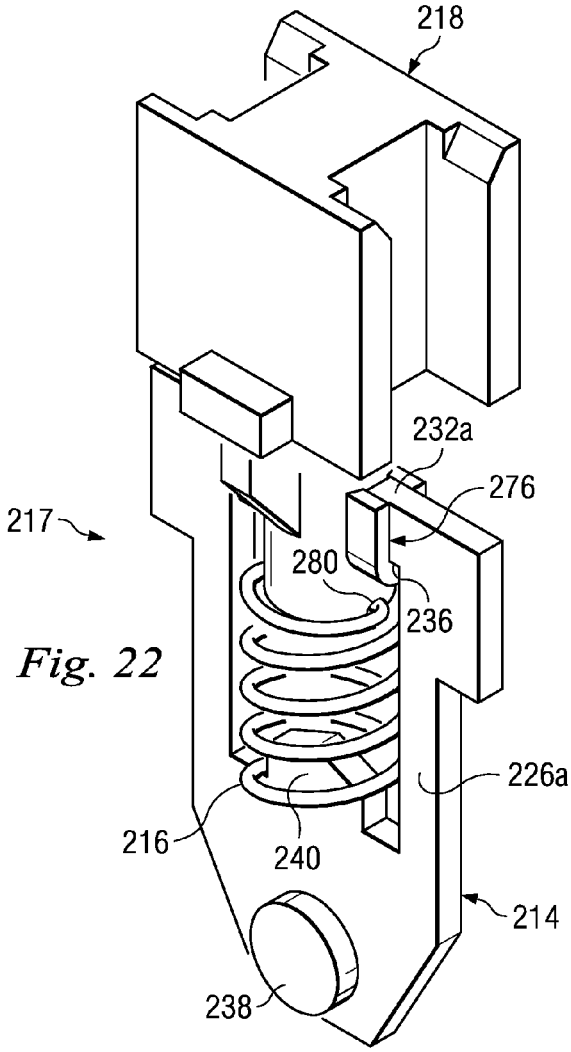
FIG. 22 is an illustration of a perspective view of an actuator assembly.

According to an exemplary embodiment, FIG. 22 shows an actuator assembly 217 including the actuator 218 in place with the flipper 214 and the spring 216. As shown, the spring 216 extends between the actuator 218 and the flipper 214. Lateral displacement of the spring 216 is limited by the spring engaging interface 240 and the spring receiving notch 280. The actuator interfacing edge 236 of the second engagement element 232 fits within the flipper engagement connection 276 on the actuator 218. Accordingly, the spring 216 biases the flipper 214 and the actuator 218 apart so that the flipper 214 and actuator 218 maintain a connected relationship. This actuator assembly 217 may be used as a sub-assembly of the combination device 200, and may assist in the assembly process. Thus, in this sub-assembled condition, the actuator assembly 217 may be introduced into place on the cradle 220. While this relationship may endure during a part of the assembly process, the actuator assembly may be modified later. For example, this may occur when the assembled flipper 214, spring 216, and actuator 218 are introduced into the bottom housing 204 so that the flipper 214 engages the cradle 220. Downward pressure from the top housing 202 and paddles 208 may further compress the spring 216 and move the actuator 218 downward relative to the flipper 214 until the interfacing edge 236 of the flipper 214 moves out of and is located above the flipper engagement connection 276. In this arrangement, the combination device 200 is operable to electrically switch to engage and disengage electrical contacts.

Figure 23A:
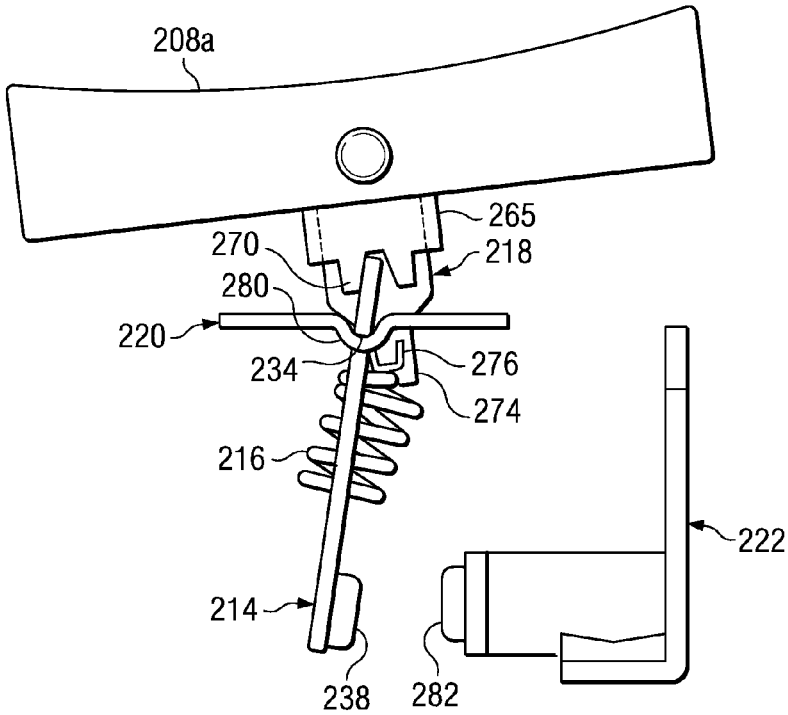
FIGS. 23A and 23B are illustrations of side views of the actuator assembly in alternate contact positions.
Figure 23B:
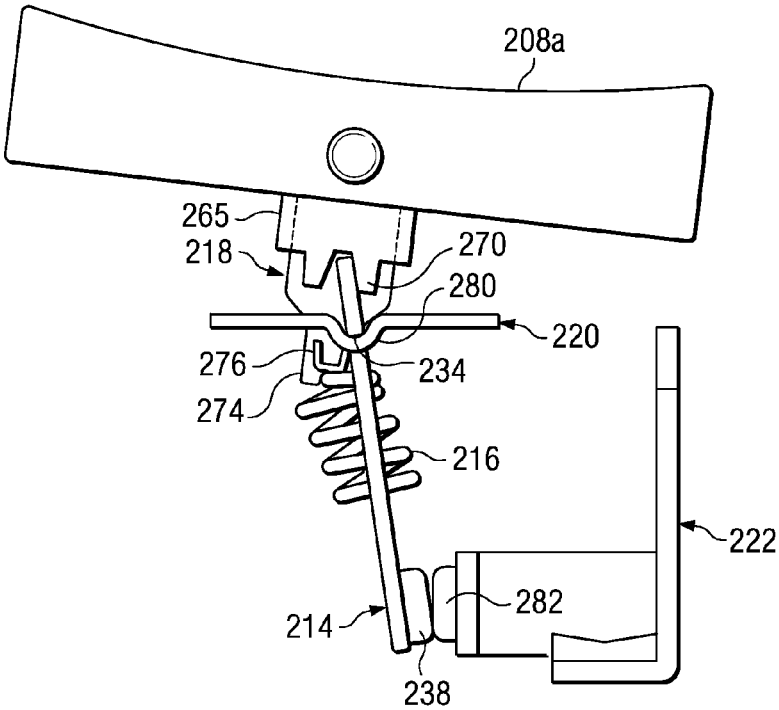

This is explained further with reference to FIGS. 23A and 23B. According to an exemplary embodiment, FIG. 23A shows a side view of the paddle 208*a*, the actuator 218, the spring 216, and the flipper 214. The flipper 214 interfaces with the cradle 220, with the cradle interfacing edge 234 of the flipper disposed within a cradle trough 280. The switch terminal 222 includes a contact 282 and is isolated from the flipper in FIG. 23A. Thus, in FIG. 23A, the switch is open.

When the paddle 208*a* is pivoted to the left, the flipper 214 is also at the left. The actuator 218 is fixed to the paddle within the bore 264 to rotate with the paddle 208*a*. As explained above and as shown in FIG. 23A, the actuator 218 and the flipper 214 are not physically engaged with each other during operation. Here, the spring 216 extends from the spring receiving notch 280 of the actuator 218 to the spring engaging protrusion 240 of the flipper. The spring force biases the flipper 214, which rocks within the cradle trough 280, so that the flipper is in the open position, thereby isolating the switch terminal 222.

According to an exemplary embodiment, FIG. 23B shows the components of FIG. 23A in a closed position. When the paddle 208*a* is pivoted to the right, the spring receiving notch 280 of the actuator 218 displaces to the right. This redirects the spring force to move the flipper 214 so that it its contact 238 creates an electrical connection with the contact 282 of the switch terminal 222.

FIGS. 24-30 show another exemplary embodiment of an electrical device shown as a combination device and referenced generally with the numeral 300. This combination device 300 is a decorator style combination device including three single pole switches. Again, as explained above the principles applied to the combination device 300 may be equally applicable to other types of combination devices and such uses are contemplated. In addition, some of the components in the combination devices described above may be similar to components in the combination device 300. Descriptions of those components above are equally applied to components in the combination device 300.

Figure 24:
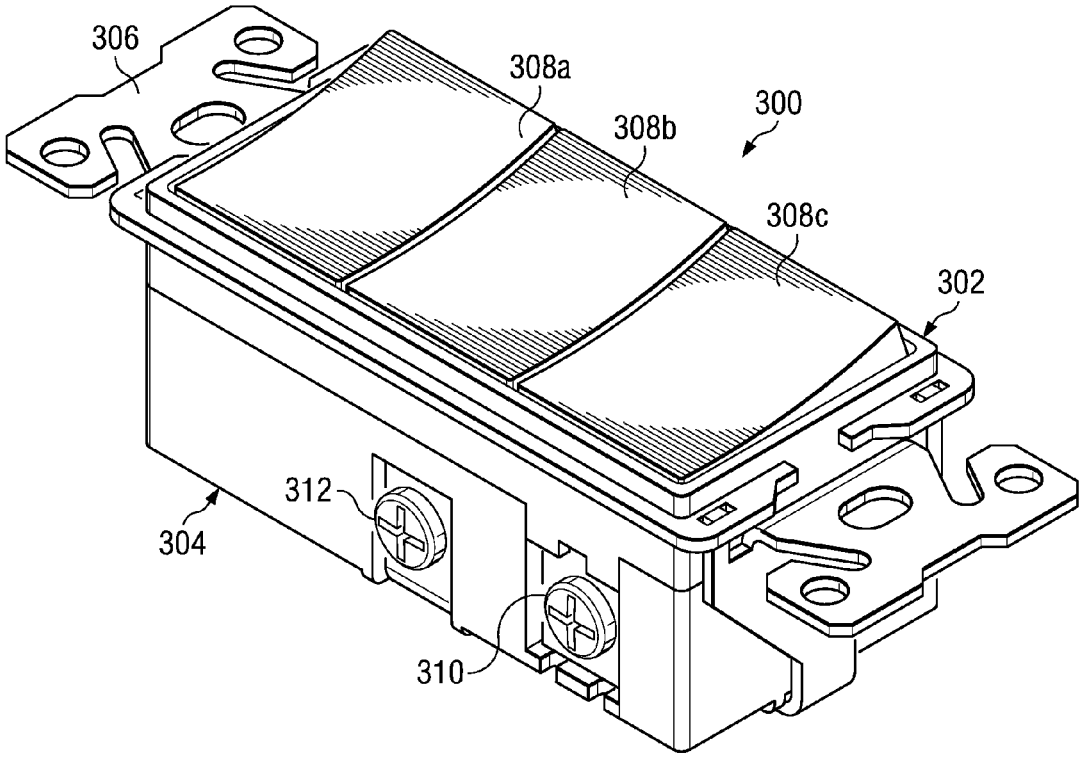
FIG. 24 is an illustration of a perspective view of an exemplary embodiment of a three-single pole decorator style combination device.

The exemplary combination device 300 in FIG. 24 includes a top housing 302, a bottom housing 304, and a mounting strap 306. The top housing 302 includes three switch components as paddles 308*a-c* operable as switches to electrically connect and disconnect electrical lines. A common terminal screw 310 and a ground screw 312 are associated with the bottom housing 304. On the opposing side, three load terminal screws 314*a-c*, shown in FIG. 25, allow connection to electrical lines.

Figure 25:
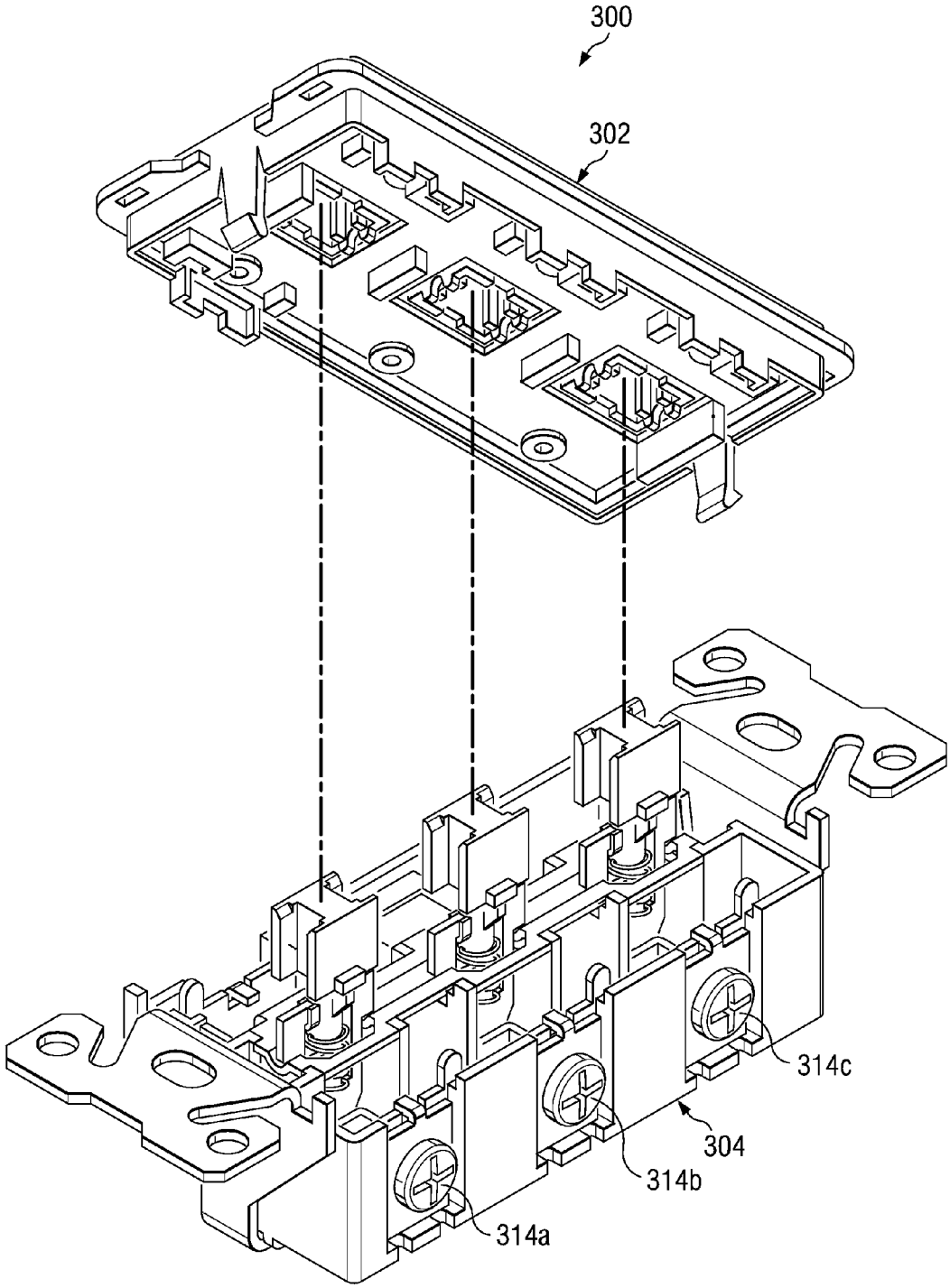
FIG. 25 is an illustration of another perspective view of the device of FIG. 24 with the top housing and paddles removed.
Figure 26:
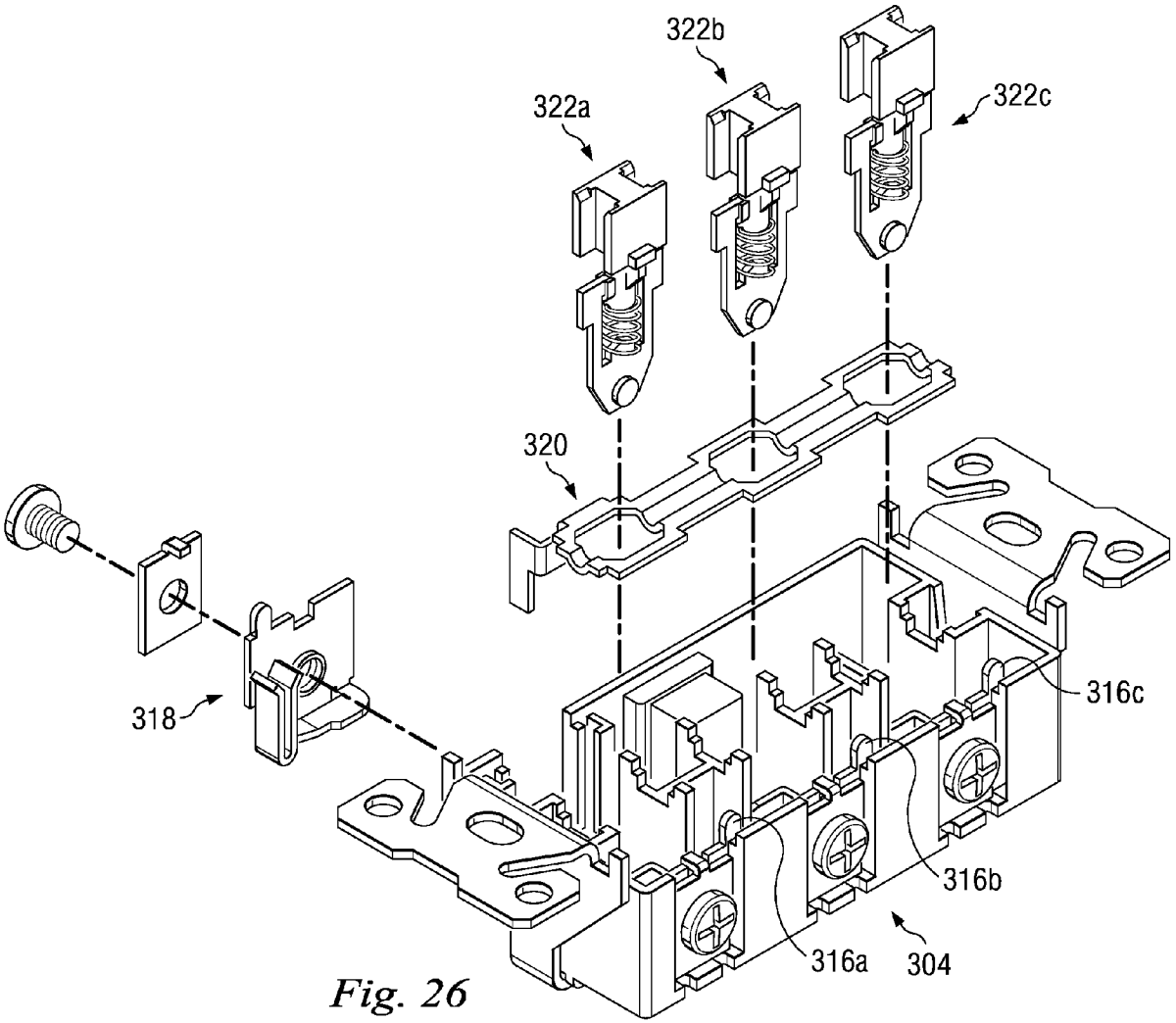
FIG. 26 is an illustration of an exploded perspective view of some of the components of FIG. 25.

According to an exemplary embodiment, FIG. 25 shows the combination device 300 with the top housing 302 removed so that inner components of the device 300 are visible. FIG. 26 is an exploded view showing some of the components of the combination device 300. The combination device 300 includes switch terminals 316*a-c*, a common terminal 318, a cradle 320, and actuator assemblies 322*a-c*.

The actuator assemblies 322*a-c* may be the same as or similar to the actuator assemblies shown in FIG. 22, including an actuator, a spring, and a flipper mechanism assembled in the manner described above. As explained above, the spring and flipper mechanism may be associated with the actuator as a sub-assembly of the combination device that may assist in the assembly process.

Figure 27:
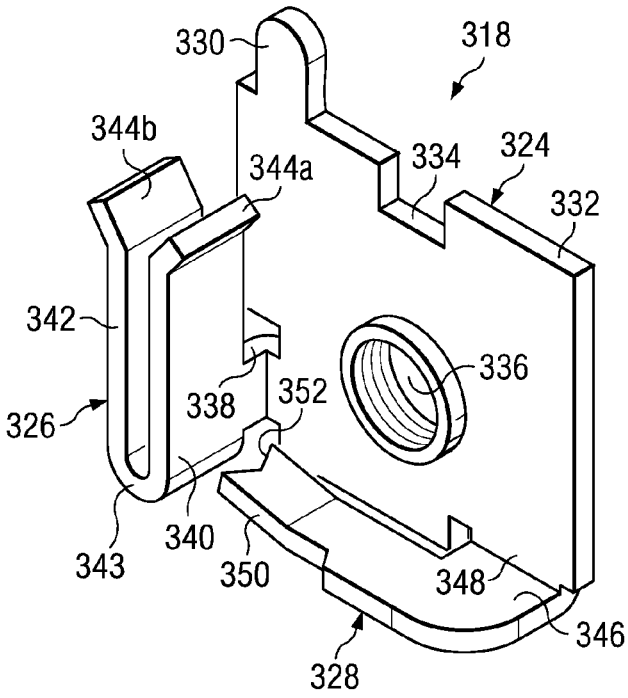
FIG. 27 is an illustration of a perspective view of a common terminal depicted in FIG. 26.

According to an exemplary embodiment, the common terminal 318, shown best in FIG. 27, includes a main wall 324, a slip receiver 326, and a cantilevered pushwire arm 328. The main wall 324 includes a projecting tab 330 extending from an upper edge 332, a slot 334 formed in the upper edge 332, and a screw receiving portion 336 configured to receive the common terminal screw 310. In the embodiment shown, the slip receiver 326 connects to the main wall 324 at a bend 338 and extends at an angle between 70° and 90° from the main wall 324. Accordingly, the bend 338 may form up to a right angle. In other embodiments, other angles are contemplated.

The slip receiver 326 is configured to cooperate with the cradle 320 to form a slip connection. In this embodiment, the slip receiver 326 is U-shaped and includes a first wall 340 connected to the bend 338 and a second wall 342 configured to lie adjacent the first wall 340. The first and second walls 340, 342 may be formed of a single plate and bent to the form the U-shaped slip receiver 326. Accordingly, the second wall 342 is not attached at its sides to the main wall 324, but instead connects to the first wall 340 only at its end at a bridge 343. The slip receiver may include any of the features described above with reference to the slip receiver 90. Upper edge portions 344*a*, 344*b* of the first and second walls 340, 342 diverge and are flared to receive a connecting component, such as a portion of the cradle 320, as is described below.

The pushwire arm 328 is configured to lie relatively flat within the bottom housing 304 and may be configured to be accessed through ports (not shown) in the bottom housing 304 to provide electrical connection to the common terminal 318. A first end 346 of the pushwire arm 328 is connected to the main wall 324 at a bend 348. The pushwire arm then is formed to turn and extend along and adjacent to a base of the main wall 324. A second end 350 of the pushwire arm 328 is cantilevered from the first end 346, and is tapered upward. The second end 350 is formed to have a V-shaped slot 352 configured to engage a wire or other connector inserted through the bottom of the bottom housing 304 to connect with the common terminal 318.

Figure 28:
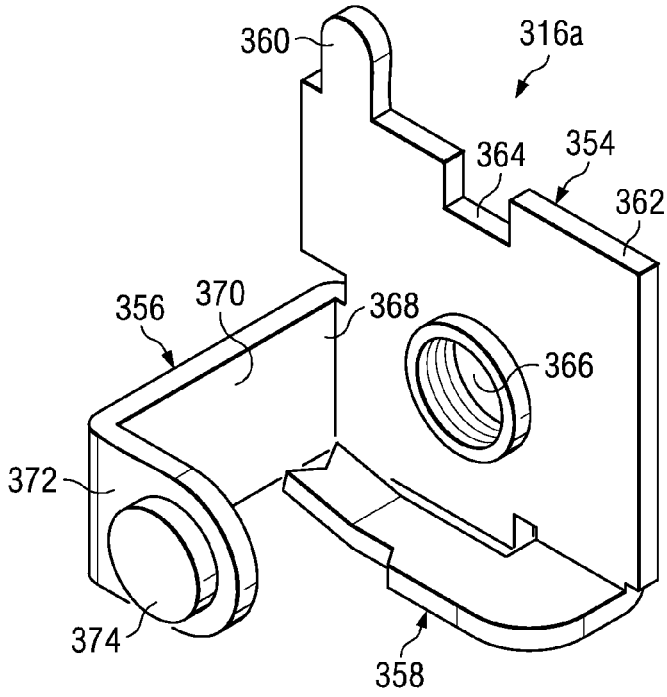
FIG. 28 is an illustration of a perspective view of a switch terminal depicted in FIG. 26.

According to an exemplary embodiment, one example of the switch terminals 316*a-c* is shown and described with reference to FIG. 28, identified as 316*a*. Each of the switch terminals 316 *a-c* may have any of the features of the switch terminals described above with reference to the combination device 10 and the combination device 200. In this exemplary embodiment having three switch terminals, they are aligned along a single side of the bottom housing 304. These switch terminals, like those described above, are configured to provide an electrical connection through the device 300. The switch terminals in this exemplary embodiment include a main wall 354, a silver contact arm 356, and a cantilevered pushwire arm 358. The main wall 354 includes a projecting tab 360 extending from an upper edge 362, a slot 364 formed in the upper edge 362, and a screw receiving portion 366 configured to receive the load terminal screw 314. In the embodiment shown, the silver contact arm 356 connects to the main wall 354 at a bend 368 and includes an extension portion 370 and a hook portion 372. The hook portion 372 is bent to lie substantially perpendicular to the extension portion 370 and to be generally parallel to the main wall 354. A contact 374 is provided in the hook portion 372.

The pushwire arm 358 is configured to be accessed through ports (not shown) in the bottom housing 304 to provide electrical connection to the switch terminal 316. This pushwire arm 358 may be similar to the pushwire arm 328 described above, and its features will not be repeated here.

Figure 29:
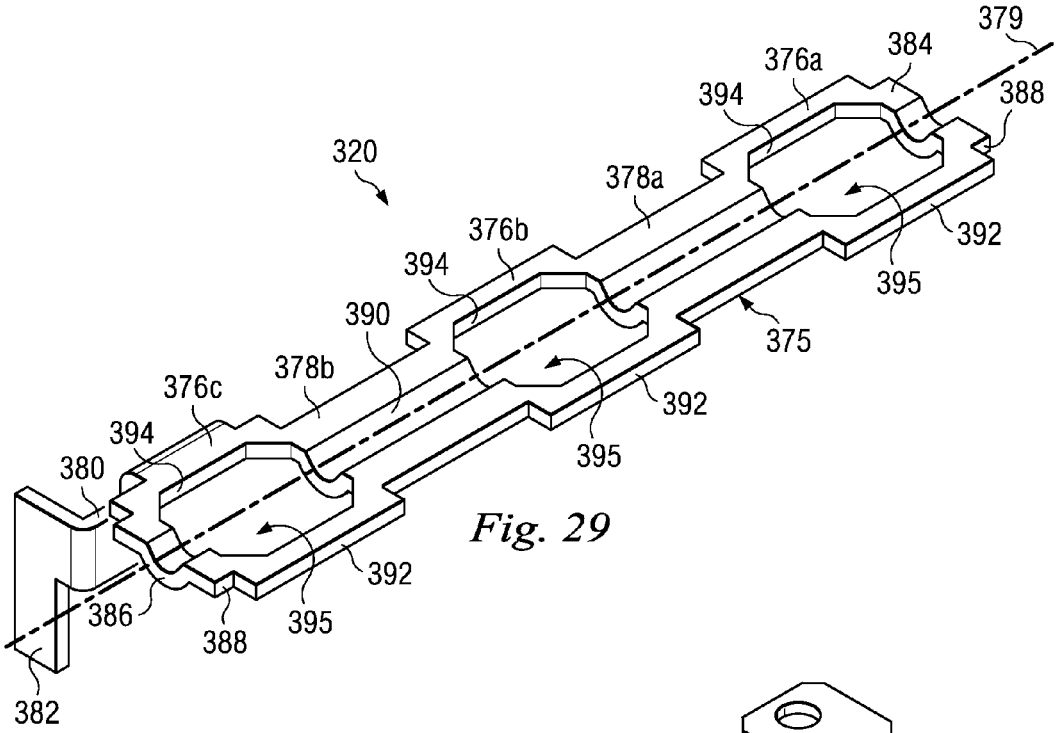
FIG. 29 is an illustration of a perspective view of a cradle depicted in FIG. 26.

FIG. 29 shows an exemplary embodiment of the cradle 320 in greater detail. The cradle 320, in this exemplary embodiment shown, includes a body portion 375 having three relatively wider cradle support regions 376*a-c* separated by two relatively narrower necks 378*a-b*, extending along a central or longitudinal axis 379. The cradle 320 also includes a transition portion 380 and a connection portion 382. At each end 384, 386, the cradle 320 includes a shoulder 388 having a width similar to that of the necks 378*a-b*. A U-shaped trough 390 extends longitudinally in a relatively straight line along the axis 379 from the first end 384 of the cradle 320 to the second end 386.

Each cradle support region 376*a-c* has a substantially rectangular outer shape at least partially defined by an outer perimeter 392 with a partially oval inner shape defined by an inner wall 394. In particular, the inner shape is a rectangle having corners angled at 45°. The inner walls 394 are shaped and sized to define apertures 395 that receive the actuator assemblies 322*a-c*, and the arms of the flippers are configured to rest in the trough 390 in the manner described above with reference to the combination device 200.

The transition portion 380 extends from a side of one of the cradle support regions 376*c* and is bent to extend downwardly into the bottom housing 304. The connection portion 382 is also bent from the transition portion 380 and formed to extend downwardly from the transition portion 380 into the bottom housing 304. The connection portion 382 is formed so that an outer surface resides in or substantially parallel to a plane defined by the surface forming the end 386.

The connection portion 382 extends from one of the cradle support regions 376*a* of the cradle 320 and is configured to fit into the slip receiver 326 of the common terminal 318, thereby providing electrical connection between the two in a manner similar to that described above with reference to FIG. 7. In this embodiment, because the cradle support regions 376*a-c* are integrally formed, the connection portion 382 serves as an electrical conduit for any electrical activity through the cradle 320. In this embodiment, the connection portion 382 is a plate formed along a plane substantially perpendicular to the longitudinal axis 379 defined by the cradle 320. Accordingly, during assembly, the connection portion 382 may be displaced in any direction along its plane relative to the slip receiver 326, including up, down, and side-to side or longitudinally and laterally. As explained above, this allows the cradle 320 to be more freely manipulated to fit properly within the bottom housing 304 while still maintaining a solid mechanical and electrical joint with the common terminal 318. Further, this allows each of the three cradle support regions 376 to be connected to one common terminal 318 through a single slip connection. It should be noted that in some embodiments, the combination device 300 includes two or four or more switches. Thus, the cradle could have two or four or more cradle support regions required to support such combination devices.

Figure 30:
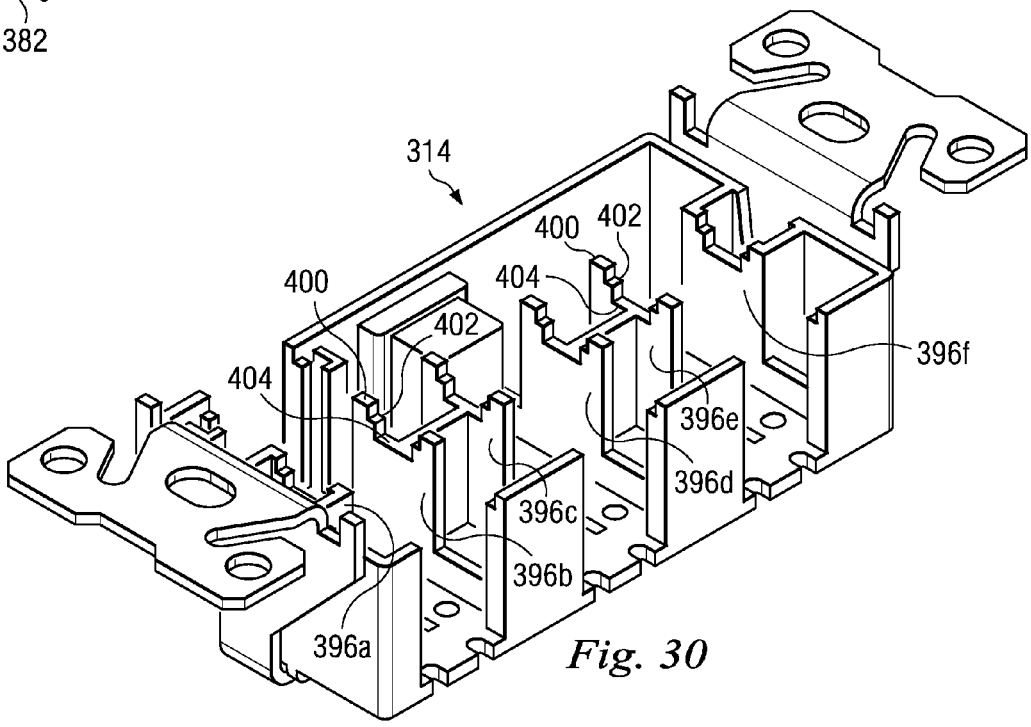
FIG. 30 is an illustration of a perspective view of a bottom housing depicted in FIG. 26.

Turning now to an exemplary embodiment shown in FIG. 30, the bottom housing 304 is shown with support posts 396*a-f* configured to support the cradle 320. In the embodiment shown, the support posts 396*a-f* extend transversely within the bottom housing 304. The support posts 396*a* and 396*f* may be formed as integral part of the outer wall of the bottom housing 304. The support posts 396 include adjacent levels at different heights. These include a boundary level 400, a support level 402, and a receiving level 404. The boundary level 400 is formed to limit longitudinal or transverse movement of the cradle 320 relative to the bottom housing 304. Accordingly, the boundary level 400 is formed to fit adjacent the necks 378 or shoulders 388 to physically block cradle movement. The support level 402 of the cradle support posts 396 interfaces with a bottom side of the cradle 320 when the bottom housing 304 is lying flat, as in the exemplary configuration shown. The receiving level 404 forms a gap in the support level 402. This receiving level 404 receives the downwardly extending U-shaped trough 390 of the cradle 320.

Figure 31:
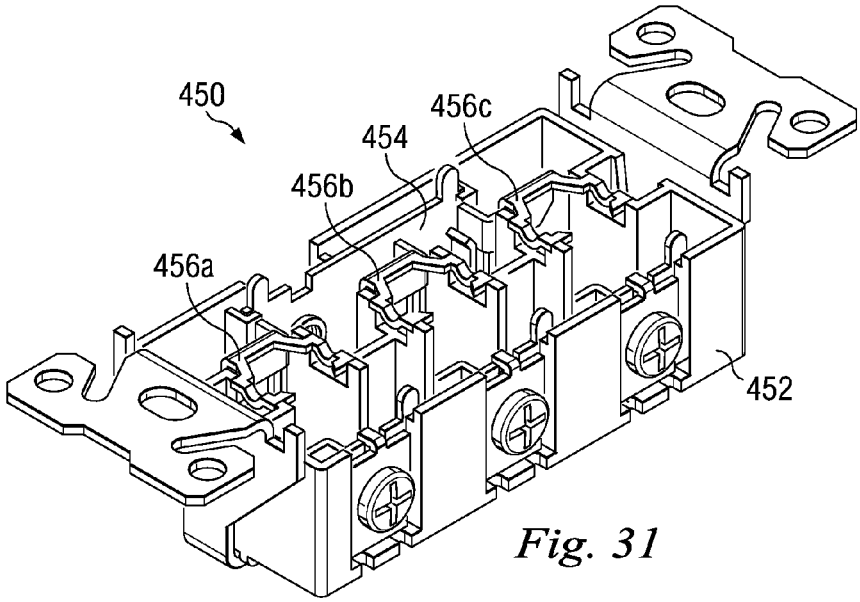
FIG. 31 is an illustration of a perspective view of a bottom housing of an alternative embodiment of a three-single pole decorator style combination device.
Figure 32:
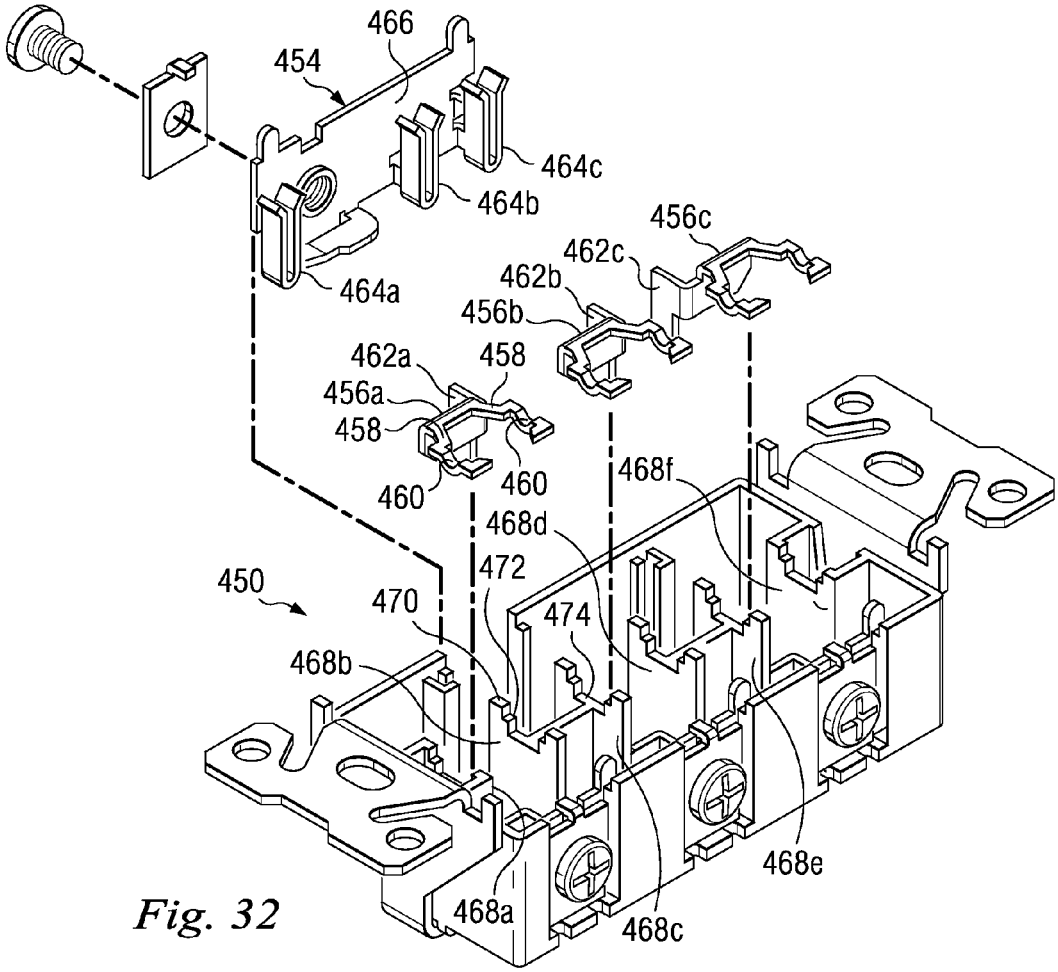
FIG. 32 is an illustration of an exploded perspective view of some of the components of FIG. 29.

According to an exemplary embodiment, FIGS. 31 and 32 show a portion of yet another exemplary electrical device as a combination device generally referred to by the reference numeral 450. This embodiment may employ the top housing 304, paddles 308, switch terminals 316, and actuator assemblies 322 described above, but includes a different bottom housing 452, common terminal 454, and cradles 456*a-c*. This embodiment may include any of the detail described herein with reference to other embodiments, but only the differences are being described here.

In this embodiment, the cradles 456 have features similar to those described above with reference to FIG. 6. However, instead of having a ring-like body portion defining a central aperture, the cradles 456 are more U-shaped when viewed from above. Each leg 458 of the U-shape includes a trough 460 configured to interface with and electrically connect with a flipper. In this embodiment, each cradle is separate from each other cradle, but each includes a connecting portion 462 configured to interface with a slip receiver 464 of the common terminal 454. In the embodiment shown, the connecting portion on two cradles 456*a-b* is disposed on the cradle right side while the connecting portion on cradle 456*c* is disposed on the cradle left side.

The common terminal 454 includes three slip receivers 464*a-c*, each for attachment to one of the cradles 456. As explained with reference to prior exemplary embodiments above, the slip receivers extend from and connect to a main wall 466. As can be seen in FIG. 32, the slip receivers may include many or all of the same features of the slip receivers described above.

The bottom housing 452 includes support posts 468*a-f* configured in a manner described above. Each of these support posts 468*a-f* includes a boundary level 470, a support level 472, and a receiving level 474. In this embodiment, two support posts provide support to each cradle 456. The cradles 456 are configured to fit within the bottom housing 452 so that the U-shaped troughs 460 fit within the receiving levels 474, and the cradles 456 are configured to rest on the support levels 472 and lie adjacent the boundary level 470, as described with reference to other embodiments.

A device has been described that includes a paddle actuatable from a first position to a second position; an actuator associated with the paddle and configured to displace when the paddle is actuated from the first position to the second position; a cradle disposed adjacent the actuator and comprising a trough formed therein; a terminal in electrical communication with the cradle; and at least one of: a) an electrical slip connection between the cradle and terminal, wherein one of the cradle and the terminal comprises a connection portion and the other of the cradle and the terminal comprises a slip receiver formed therein for slidably receiving the connection portion to establish the electrical slip connection between the cradle and the terminal; and b) a plurality of integral cradle support regions formed in the cradle, the trough being formed through each cradle support region. In an exemplary embodiment, the device comprises a spring, wherein the actuator comprises a paddle end and a switch component end, the paddle end comprising an H-shaped body and being configured to interface with the paddle, the switch component end being configured to interface with the spring. In an exemplary embodiment, the switch component end comprises a cylindrical element comprising a flipper engagement connection for engaging the flipper and a spring-receiving notch for interfacing with the spring. In an exemplary embodiment, the cradle comprises three cradle support regions. In an exemplary embodiment, the cradle comprises at least one neck extending between the plurality of cradle support regions, the neck comprising a width less than a width of the cradle support regions. In an exemplary embodiment, the cradle comprises a central aperture formed in each of the cradle support regions. In an exemplary embodiment, the terminal comprises a single slip receiver and the cradle comprises a single connecting portion interfacing with the slip receiver to provide the electrical communication, and wherein each of the plurality of cradle support regions is in electrical communication with the terminal through the single connecting portion. In an exemplary embodiment, the slip receiver comprises two arms comprising diverging edge portions. In an exemplary embodiment, the slip receiver comprises first and second arms and a bridge connecting the two arms. In an exemplary embodiment, the connection portion is a rectangular plate. In an exemplary embodiment, the connection portion is movable along a plane within the slip receiver. In an exemplary embodiment, the cradle is independently adjustable relative to the terminal while the connection portion is disposed within the slip receiver. In an exemplary embodiment, the cradle comprises a U-shaped body portion with the trough being formed in legs of the body portion. In an exemplary embodiment, the device comprises a plurality of cradles and a single terminal, wherein the terminal comprises a plurality of slip receivers and each one of the plurality of cradles comprises a connection portion receivable in a respective one of the plurality of slip receivers to create the slip connections. In an exemplary embodiment, the device comprises three slip connections between three cradles and the terminal. In an exemplary embodiment, the device comprises a coil spring comprising a cross-member portion extending across an end.

An electrical device has been described that comprises a top housing; a bottom housing coupled to the top housing, the bottom housing comprising cradle support posts extending transversely within the bottom housing and comprising adjacent levels of a boundary level and a support level; a mounting strap associated with at least one of the top and bottom housings; a paddle associated with the top housing, the paddle being actuatable between a first and a second position; an actuator extending from the paddle, the actuator comprising a paddle end and a switch component end, the paddle end comprising an H-shaped body and being configured to interface with the paddle, the switch component end being comprising a cylindrical element comprising a flipper engagement connection formed thereon and comprising a spring receiving notch formed therein; a coil spring extending from the actuator, the spring comprising a cross member portion extending into the spring receiving notch; a U-shaped flipper mechanism comprising first and second arms connected by a bridge portion, the first and second arms each comprising an oppositely extending protruding portion, each protruding portion comprising a lower cradle interfacing edge, wherein the bridge portion comprises a spring interface portion extending between the first and second arms, the coil spring being associated with the spring interface portion, the bridge portion comprising a centrally disposed electrical contact; a switch terminal disposed in the bottom housing and comprising a screw receiving aperture and an electrical contact; a cradle disposed in the bottom housing, the cradle comprising a body portion, a transition portion, and a connection portion, wherein the body portion comprises a trough, wherein the transition portion is bent from the body portion and extends between the body portion and the connection portion, and wherein the connection portion is a rectangular plate, and wherein the cradle is disposed to interface with the cradle support posts so that the cradle rests on the support level of the support posts and adjacent to the boundary level of the support posts, wherein the flipper mechanism is disposed in a manner that the cradle interfacing edge of the flipper mechanism extends into and contacts the trough of the body portion of the cradle, and wherein the flipper mechanism is suspended by the trough and is movable in a manner that brings the electrical contact on the bridge portion of the flipper mechanism into contact with and out of contact with the electrical contact on the switch terminal; and a common terminal comprising a main wall and a slip receiver, the main wall comprising a screw receiving aperture, the slip receiver being connected to and angled away from the main wall, the slip receiver comprising first and second walls connected by an integral receiver bridge, wherein the second wall is directly connected to the main wall and the first wall is supported by the second wall; wherein the connection portion of the cradle is disposed between the first and second walls of the slip receiver in a manner to complete an electrical connection between the cradle and the common terminal, the connection portion of the cradle being moveable within the slip receiver in any direction of a plane.

A method has been described that includes providing a paddle for an electrical switching device, the paddle being actuatable from a first position to a second position; associating an actuator with the paddle, the actuator being configured to displace when the paddle is actuated from the first position to the second position; placing a terminal and a cradle within an electrical housing, the cradle comprising a body portion comprising troughs formed therein, the terminal and cradle being in electrical communication; and at least one of the following: a) introducing a connection portion of one of the cradle and terminal to a slip receiver of the other of the cradle and terminal to establish an electrical slip connection between the cradle and the terminal; and b) aligning the cradle comprising a plurality of integral cradle support regions within the housing, the trough being formed through each cradle support region. In an exemplary embodiment, the method comprises introducing a spring to the switch component end of the actuator so that a cross member portion of the spring extends into a spring receiving notch in the switch component end. In an exemplary embodiment, the method comprises connecting the spring about a spring interface portion on a flipper mechanism; and securing the flipper mechanism to a flipper engagement connection on the actuator. In an exemplary embodiment, the method comprises introducing the flipper mechanism to the cradle so that a cradle interfacing edge of the flipper mechanism extends into and contacts the trough of the cradle. In an exemplary embodiment, the method comprises applying a load to the actuator to compress the spring and displace the actuator relative to the flipper mechanism and disengage the flipper engagement connection of the actuator from the flipper mechanism. In an exemplary embodiment, the method comprises actuating the paddle from the first position to the second position to displace the actuator and the spring, the spring acting on the flipper mechanism to displace the flipper mechanism so that an electrical contact on a bridge portion of the flipper mechanism moves into contact with and out of contact with an electrical contact on a switch terminal. In an exemplary embodiment, aligning the cradle comprises orienting shoulder portions on the cradle to fit adjacent boundary levels on cradle support posts. In an exemplary embodiment, the introducing a connection portion comprises slidably inserting the connection portion between first and second walls of the slip receiver. In an exemplary embodiment, the method comprises transferring electrical current through a plurality of flippers associated with the plurality of cradle supports through a single connection with the terminal.

A method has been described that includes providing a paddle for an electrical switching device, the paddle being actuatable from a first position to a second position; associating an actuator with the paddle, the actuator being configured to displace when the paddle is actuated from the first position to the second position, the actuator comprising a paddle end and a switch component end, the paddle end comprising an H-shaped body and being configured to interface with the paddle, the switch component end being comprising a cylindrical element comprising a flipper engagement connection formed thereon for engaging the flipper and comprising a spring receiving notch formed therein; placing a switch terminal within an electrical housing, the switch terminal comprising an electrical contact formed thereon; placing a common terminal within the electrical housing, the common terminal comprising a main wall and a slip receiver, the main wall comprising a screw receiving aperture, the slip receiver being connected to and angled away from the main wall, the slip receiver comprising first and second walls connected by an integral receiver bridge, wherein the second wall is directly connected to the main wall and the first wall is supported by the second wall; placing a cradle within the electrical housing, the cradle comprising a body portion, a transition portion, and a connection portion, wherein the body portion comprises a trough, wherein the transition portion is bent from the body portion and extends between the body portion and the connection portion, and wherein the connection portion is a rectangular plate, and wherein the cradle is disposed to interface with cradle support posts so that the cradle rests on support levels of support posts and adjacent to boundary levels of the support posts; slidably introducing the connection portion of the cradle into the slip receiver of the common terminal to create an electrical connection; introducing a spring to the switch component end of the actuator so that a cross member portion of the spring extends into the spring receiving notch in the switch component end; connecting the spring about a spring interface portion on a flipper mechanism so that the spring extends from the flipper mechanism to the actuator; securing the flipper mechanism to a flipper engagement connection on the actuator; introducing the flipper mechanism to the cradle so that a cradle interfacing edge of the flipper mechanism extends into and contacts the trough of the cradle and so that the flipper mechanism is suspended by the trough and is movable in a manner that brings an electrical contact on the bridge portion of the flipper mechanism into contact with and out of contact with the electrical contact on the switch terminal; applying a load to the actuator to compress the spring and displace the actuator relative to the flipper mechanism and disengage the flipper engagement connection of the actuator from the flipper mechanism; and actuating the paddle from the first position to the second position to displace the actuator and the spring such that spring acts on the flipper mechanism to displace the flipper mechanism so that the electrical contact on the bridge portion of the flipper mechanism moves into contact with and out of contact with the electrical contact on the switch terminal.

A system has been described that includes means for providing a paddle for an electrical switching device, the paddle being actuatable from a first position to a second position; means for associating an actuator with the paddle, the actuator being configured to displace when the paddle is actuated from the first position to the second position; means for placing a terminal and a cradle within an electrical housing, the cradle comprising a body portion comprising troughs formed therein, the terminal and cradle being in electrical communication; and at least one of the following: a) means for introducing a connection portion of one of the cradle and terminal to a slip receiver of the other of the cradle and terminal to establish an electrical slip connection between the cradle and the terminal; and b) means for aligning the cradle comprising a plurality of integral cradle support regions within the housing, the trough being formed through each cradle support region. In an exemplary embodiment, the system comprises means for introducing a spring to the switch component end of the actuator so that a cross member portion of the spring extends into a spring receiving notch in the switch component end. In an exemplary embodiment, the system comprises means for connecting the spring about a spring interface portion on a flipper mechanism; and means for securing the flipper mechanism to a flipper engagement connection on the actuator. In an exemplary embodiment, the system comprises means for introducing the flipper mechanism to the cradle so that a cradle interfacing edge of the flipper mechanism extends into and contacts the trough of the cradle. In an exemplary embodiment, the system comprises means for applying a load to the actuator to compress the spring and displace the actuator relative to the flipper mechanism and disengage the flipper engagement connection of the actuator from the flipper mechanism. In an exemplary embodiment, the system comprises means for actuating the paddle from the first position to the second position to displace the actuator and the spring, the spring acting on the flipper mechanism to displace the flipper mechanism so that an electrical contact on a bridge portion of the flipper mechanism moves into contact with and out of contact with an electrical contact on a switch terminal. In an exemplary embodiment, the means for aligning the cradle comprises means for orienting shoulder portions on the cradle to fit adjacent boundary levels on cradle support posts. In an exemplary embodiment, the means for introducing a connection portion comprises means for slidably inserting the connection portion between first and second walls of the slip receiver. In an exemplary embodiment, the system comprises means for transferring electrical current through a plurality of flippers associated with the plurality of cradle supports through a single connection with the terminal.

A system is described that includes means for providing a paddle for an electrical switching device, the paddle being actuatable from a first position to a second position; means for associating an actuator with the paddle, the actuator being configured to displace when the paddle is actuated from the first position to the second position, the actuator comprising a paddle end and a switch component end, the paddle end comprising an H-shaped body and being configured to interface with the paddle, the switch component end being comprising a cylindrical element comprising a flipper engagement connection formed thereon for engaging the flipper and comprising a spring receiving notch formed therein; means for placing a switch terminal within an electrical housing, the switch terminal comprising an electrical contact formed thereon; means for placing a common terminal within the electrical housing, the common terminal comprising a main wall and a slip receiver, the main wall comprising a screw receiving aperture, the slip receiver being connected to and angled away from the main wall, the slip receiver comprising first and second walls connected by an integral receiver bridge, wherein the second wall is directly connected to the main wall and the first wall is supported by the second wall; means for placing a cradle within the electrical housing, the cradle comprising a body portion, a transition portion, and a connection portion, wherein the body portion comprises a trough, wherein the transition portion is bent from the body portion and extends between the body portion and the connection portion, and wherein the connection portion is a rectangular plate, and wherein the cradle is disposed to interface with cradle support posts so that the cradle rests on support levels of support posts and adjacent to boundary levels of the support posts; means for slidably introducing the connection portion of the cradle into the slip receiver of the common terminal to create an electrical connection; means for introducing a spring to the switch component end of the actuator so that a cross member portion of the spring extends into the spring receiving notch in the switch component end; means for connecting the spring about a spring interface portion on a flipper mechanism so that the spring extends from the flipper mechanism to the actuator; means for securing the flipper mechanism to a flipper engagement connection on the actuator; means for introducing the flipper mechanism to the cradle so that a cradle interfacing edge of the flipper mechanism extends into and contacts the trough of the cradle and so that the flipper mechanism is suspended by the trough and is movable in a manner that brings an electrical contact on the bridge portion of the flipper mechanism into contact with and out of contact with the electrical contact on the switch terminal; means for applying a load to the actuator to compress the spring and displace the actuator relative to the flipper mechanism and disengage the flipper engagement connection of the actuator from the flipper mechanism; and means for actuating the paddle from the first position to the second position to displace the actuator and the spring such that spring acts on the flipper mechanism to displace the flipper mechanism so that the electrical contact on the bridge portion of the flipper mechanism moves into contact with and out of contact with the electrical contact on the switch terminal.

A toggle for an electrical device has been described that includes a lever portion configured for flipping between a first and a second position; a base portion supporting the lever portion; and a flange portion extending outwardly along at least two sides of the base portion. In an exemplary embodiment, the base portion is rectangular and comprises two longer sides and two shorter sides, the flange extending along the two longer sides. In an exemplary embodiment, the flange extends outwardly along four sides of the base portion. In an exemplary embodiment, a first portion of the flange extends along a bottom edge of a first side of the at least two sides of the base portion and wherein a second portion of the flange angles along the first side toward the lever portion. In an exemplary embodiment, the second portion of the flange ends at a pivot pin extending from the base portion. In an exemplary embodiment, the flange extends along a bottom edge of the base portion. In an exemplary embodiment, the toggle comprises a rotation limiter along a first of the at least two sides of the base portion, the rotation limiter being configured to mechanically interface with a housing portion to limit the rotation of the toggle, the flange extending along the first side and ending at the rotation limiter. In an exemplary embodiment, the flange portion extends along at least half of the at least two sides. In an exemplary embodiment, the flange portion increases the minimum width of the base portion. In an exemplary embodiment, the flange portion increases the minimum length of the base portion.

An electrical switching device has been described that includes a housing comprising a switch aperture; and a toggle extending through the switch aperture, the toggle comprising a flange portion configured in a manner that limits visibility through the switch aperture. In an exemplary embodiment, the flange portion extends outwardly along at least two sides of the base portion. In an exemplary embodiment, the switch aperture has a length and a width, and wherein the flange portion defines an outer base portion width, the base portion width being greater than the switch aperture width. In an exemplary embodiment, the flange portion defines an outer base portion length, the outer base portion length being greater than the switch aperture length. In an exemplary embodiment, the toggle flange is configured to selectively interface with an inner portion of the housing to limit the visibility. In an exemplary embodiment, the toggle comprises two outwardly extending pivot pins that interface with the housing. In an exemplary embodiment, the housing comprises a chamfer along an inner edge of the switch aperture, the flange being configured for placement adjacent the chamfer.

An electrical device has been described that includes a top housing comprising an outer surface, an inner surface, and a substantially rectangular switch aperture, the switch aperture being defined by an aperture wall comprising first, second, third and fourth faces, the first and second faces comprising a length shorter than the third and fourth faces, wherein edges defined by the inner surface and the first and second faces of the aperture wall are chamfered to form an angle; a bottom housing coupled to the top housing; a toggle associated with the top housing, the toggle comprising a lever portion configured for flipping between a first and a second position, a base portion adjacent the lever portion, the base portion being substantially rectangular with first, second, third and fourth sides, the first and second sides being shorter than the third and fourth sides, the base portion comprising a bottom edge, first and second pivot pins extending oppositely outward from the base portion from the third and fourth sides, the pivot pins being cooperatively associated with the top housing in a manner that allows pivoting of the toggle between the first position and the second position, a rotation limiter along the fourth side configured to mechanically interface with a housing portion to limit the rotation of the toggle, a flange extending along the bottom edge of the third and fourth sides of the base portion, and wherein the flange on the third side of the base portion comprises a first portion extending along the bottom edge and comprises a second portion that angles along the third side toward the lever portion, and wherein the flange on the fourth side of the base portion ends at the rotation limiter, and wherein a minimum outer width of the flange and base portion is greater than a minimum width of the switch aperture, a spring interface portion extending away from the lever portion and protruding out of the base portion, the spring interface portion comprising a center protrusion and shoulder portion, side wall portions disposed on opposing sides of spring interface portion and extending substantially planar with the third and fourth sides of the base portion, the side wall portions comprising a cutout formed therein extending toward the lever; and a coil spring extending from the spring interface portion of the toggle away from the lever, the spring fitting about the center protrusion and contacting the shoulder portion.

A method has been described that includes providing an electrical switch housing comprising a switch aperture; inserting a toggle comprising a base portion at least partially through the switch aperture; and limiting visibility into the housing between the switch aperture and the base portion. In an exemplary embodiment, limiting visibility into the housing comprises providing a flange extending outwardly from the base portion. In an exemplary embodiment, the inserting the toggle comprises orienting the toggle so that the flange simultaneously restricts visibility between the switch aperture and the base portion along two sides of the toggle. In an exemplary embodiment, the method comprises selectively contacting a chamfered edge of the switch aperture with the flange. In an exemplary embodiment, the method comprises contacting the housing with a motion stop extending from one side of the toggle. In an exemplary embodiment, the base portion comprises first and second shorter sides and third and fourth longer sides, the method comprising: associating pivot pins extending from opposing sides of the base portion with an inner surface of the housing; and pivoting the toggle relative the housing about the pivot pins. In an exemplary embodiment, limiting visibility into the housing between the switch aperture and the base portion is a result of shifting a flange disposed at one of the sides of the base portion to a location overlapping an associated side of the switch aperture.

A method has been described that includes providing an electrical switch housing comprising a substantially rectangular switch aperture, the housing comprising an outer and an inner surface, the switch aperture being defined by an aperture wall comprising first, second, third and fourth faces, the first and second faces comprising a length shorter than the third and fourth faces; inserting a toggle at least partially through the switch aperture, the toggle comprising a lever portion and a base portion, the base portion being substantially rectangular with first, second, third and fourth sides, the first and second sides being shorter than the third and fourth sides, the toggle comprising a flange disposed along a bottom edge of the base portion such that a minimum width of the toggle is greater than a minimum width of the switch aperture, and wherein the flange along the third and fourth sides is disposed adjacent the respective third and fourth faces of the housing when the toggle is in a first position to limit visibility through the switch aperture along the third and fourth faces; and flipping the toggle from a first position to a second position while continuing to limit visibility through the switch aperture along the third and fourth faces.

A system has been described that includes means for providing an electrical switch housing comprising a switch aperture; means for inserting a toggle comprising a base portion at least partially through the switch aperture; and means for limiting visibility into the housing between the switch aperture and the base portion. In an exemplary embodiment, the system comprises means for limiting visibility into the housing comprises means for providing a flange extending outwardly from the base portion. In an exemplary embodiment, the means for inserting the toggle comprises means for orienting the toggle so that the flange simultaneously restricts visibility between the switch aperture and the base portion along two sides of the toggle. In an exemplary embodiment, the system comprises means for selectively contacting a chamfered edge of the switch aperture with the flange. In an exemplary embodiment, the system comprises means for contacting the housing with a motion stop extending from one side of the toggle. In an exemplary embodiment, the base portion comprises first and second shorter sides and third and fourth longer sides, the method comprising: means for associating pivot pins extending from opposing sides of the base portion with an inner surface of the housing; and means for pivoting the toggle relative the housing about the pivot pins. In an exemplary embodiment, the means for limiting visibility into the housing between the switch aperture and the base portion is a result of a means for shifting a flange disposed at one of the sides of the base portion to a location overlapping an associated side of the switch aperture.

A system has been described that includes means for providing an electrical switch housing comprising a substantially rectangular switch aperture, the housing comprising an outer and an inner surface, the switch aperture being defined by an aperture wall comprising first, second, third and fourth faces, the first and second faces comprising a length shorter than the third and fourth faces; means for inserting a toggle at least partially through the switch aperture, the toggle comprising a lever portion and a base portion, the base portion being substantially rectangular with first, second, third and fourth sides, the first and second sides being shorter than the third and fourth sides, the toggle comprising a flange disposed along a bottom edge of the base portion such that the minimum width of the toggle is greater than a minimum width of the switch aperture, and wherein the flange along the third and fourth sides is disposed adjacent the respective third and fourth faces of the housing when the toggle is in a first position to limit visibility through the switch aperture along the third and fourth faces; and means for flipping the toggle from a first position to a second position while continuing to limit visibility through the switch aperture along the third and fourth faces.

A device has been described that includes a toggle comprising a lever and a base portion; and a flipper mechanism cooperatively associated with the toggle, the flipper mechanism extending substantially away from the toggle and comprising a contact configured to contact an electrical terminal in a manner that the switch is selectively opened and closed. In an exemplary embodiment, the toggle comprises a spring interface portion extending toward the flipper mechanism. In an exemplary embodiment, the device comprises a spring extending between the spring interface portion and the flipper mechanism. In an exemplary embodiment, the spring interface portion is integral with the toggle. In an exemplary embodiment, the spring interface portion comprises a center protrusion and a shoulder portion. In an exemplary embodiment, the device comprises a spring extending between the spring interface portion and the flipper mechanism, the spring extending around the center protrusion and applying a biasing force against the shoulder portion of the toggle. In an exemplary embodiment, the toggle comprises side wall portions comprising a cutout therein for receiving the flipper mechanism. In an exemplary embodiment, the flipper mechanism comprises two arms and a bridge portion forming a U-shape, and wherein the toggle comprises a spring interface portion extending between the two arms. In an exemplary embodiment, the device comprises a spring extending between the spring interface portion and the flipper mechanism. In an exemplary embodiment, the device comprises a spring extending between and connecting to the toggle and the flipper mechanism. In an exemplary embodiment, the device comprises a top housing and a bottom housing, the toggle extending though the top housing and the flipper mechanism extending into the bottom housing.

An electrical device has been described that includes a top housing comprising a switch portion; a bottom housing coupled to the top housing; a toggle associated with the top housing, the toggle comprising a lever disposed to extend out of the switch portion, a base portion adjacent the lever portion, a spring interface portion extending away from the lever portion and protruding out of the base portion, the spring interface portion comprising a center protrusion and shoulder portion, side wall portions disposed on opposing sides of spring interface portion and extending substantially planar with a portion of the base portion, the side wall portions comprising a cutout formed therein, and first and second pivot pins extending oppositely outward from the base portion, the pivot pins being corporately associated with the top housing in a manner that allows pivoting of the toggle between a first position and a second position; a coil spring extending from the spring interface portion of the toggle away from the lever, the spring fitting about the center protrusion and contacting the shoulder portion; a U-shaped flipper mechanism comprising first and second arms connected by a bridge portion, the first and second arms each comprising an oppositely extending protruding portion, each protruding portion comprising a lower cradle interfacing edge, wherein the bridge portion comprises a spring interface portion extending between the first and second arms toward the toggle, the spring interface portion comprising a base portion with a first width and comprising a central region with a second width, the second width being greater than the first width, the bridge portion comprising a centrally disposed electrical contact; a switch terminal comprising a screw receiving aperture and an electrical contact; a cradle disposed in the bottom housing and comprising a central aperture and a U-shaped trough, the flipper extending through the central aperture in a manner that the cradle interfacing edge of the flipper portion extends into and contacts the trough, and wherein the flipper mechanism is suspended by the cradle and the flipper mechanism is movable in a manner that brings the electrical contact on the bridge portion of the flipper into contact with and out of contact with the electrical contact on the switch terminal.

A method has been described that includes actuating a toggle comprising a lever from a first position to a second position; providing a flipper mechanism extending away from the toggle and comprising an electrical contact; and displacing the flipper mechanism as a result of the actuating the toggle from the first position to the second position, to contact an electrical terminal with the electrical contact on the flipper mechanism to selectively close the switch when the toggle is in the second position. In an exemplary embodiment, the method comprises actuating the toggle from the second position to the first position; and displacing the flipper mechanism away from the electrical terminal as a result of the actuating the toggle from the second position to the first portion, to selectively open the switch when the toggle is in the first position. In an exemplary embodiment, displacing the flipper mechanism comprises flexing a spring extending between a spring interfacing portion of the toggle and a spring interface portion on the flipper mechanism, the spring providing a biasing force that displaces the flipper mechanism. In an exemplary embodiment, the spring is a coil spring, and wherein flexing the spring comprises moving an end of the spring with the spring interfacing portion of the toggle, the spring interfacing portion comprising a center protrusion extending into the coil spring and comprising a shoulder portion supporting the coil spring. In an exemplary embodiment, the method comprises flexing a spring that extends between a spring interfacing portion on the toggle and a spring interfacing portion on the flipper mechanism, the spring providing a biasing force that moves the flipper mechanism.

A method has been described that includes providing electrical current to an electrical device comprising a switch portion; actuating a toggle associated with the switch portion from a first position to a second position, the toggle comprising a lever and a spring interface portion that comprises a center protrusion and a shoulder portion, the spring interface portion extending away from the lever, wherein actuating the toggle comprises displacing the spring interface portion; flexing a coil spring connected to the spring interface portion in manner that the spring receives the center protrusion and rests upon the shoulder portion, the coil spring being arranged to flex when the toggle is actuated; displacing a U-shaped flipper mechanism connected to the spring, the flipper mechanism comprising a first and a second arm connected by a bridge portion, wherein the bridge portion comprises an electrical contact, and wherein displacing the flipper mechanism comprises moving the bridge portion with the electrical contact into contact with a switch terminal to permit electrical communication between the electrical contact and the switch terminal; flowing the current through the switch terminal into the flipper mechanism, and through the first and second arms of the flipper mechanism to a cradle comprising a central aperture and a trough formed therein for supporting the flipper mechanism, and flowing current through the cradle to a common terminal; actuating the toggle from the second position to the first position; flexing the coil spring connected to the spring interface portion of the toggle; and displacing the flipper mechanism connected to the spring to move the bridge portion with the electrical contact away from the switch terminal to stop electrical communication between the electrical contact and the switch terminal.

A system has been described that includes means for actuating a toggle comprising a lever from a first position to a second position; means for providing a flipper mechanism extending away from the toggle and comprising an electrical contact; and means for displacing the flipper mechanism as a result of the actuating the toggle from the first position to the second position, to contact an electrical terminal with the electrical contact on the flipper mechanism to selectively close the switch when the toggle is in the second position. In an exemplary embodiment, the system comprises means for actuating the toggle from the second position to the first position; and means for displacing the flipper mechanism away from the electrical terminal as a result of the actuating the toggle from the second position to the first portion, to selectively open the switch when the toggle is in the first position. In an exemplary embodiment, the means for displacing the flipper mechanism comprises means for flexing a spring extending between a spring interfacing portion of the toggle and a spring interface portion on the flipper mechanism, the spring providing a biasing force that displaces the flipper mechanism. In an exemplary embodiment, the spring is a coil spring, and the means for flexing the spring comprises means for moving an end of the spring with the spring interfacing portion of the toggle, the spring interfacing portion comprising a center protrusion extending into the coil spring and comprising a shoulder portion supporting the coil spring. In an exemplary embodiment, the system comprises means for flexing a spring that extends between a spring interfacing portion on the toggle and a spring interfacing portion on the flipper mechanism, the spring providing a biasing force that moves the flipper mechanism.

A system has been described that includes means for providing electrical current to an electrical device comprising a switch portion; means for actuating a toggle associated with the switch portion from a first position to a second position, the toggle comprising a lever and a spring interface portion that comprises a center protrusion and a shoulder portion, the spring interface portion extending away from the lever, wherein the means for actuating the toggle comprises means for displacing the spring interface portion; means for flexing a coil spring connected to the spring interface portion in manner that the spring receives the center protrusion and rests upon the shoulder portion, the coil spring being arranged to flex when the toggle is actuated; means for displacing a U-shaped flipper mechanism connected to the spring, the flipper mechanism comprising a first and a second arm connected by a bridge portion, wherein the bridge portion comprises an electrical contact, and wherein the means for displacing the flipper mechanism comprises means for moving the bridge portion with the electrical contact into contact with a switch terminal to permit electrical communication between the electrical contact and the switch terminal; means for flowing the current through the switch terminal into the flipper mechanism, and through the first and second arms of the flipper mechanism to a cradle comprising a central aperture and a trough formed therein for supporting the flipper mechanism, and means for flowing current through the cradle to a common terminal; means for actuating the toggle from the second position to the first position; means for flexing the coil spring connected to the spring interface portion of the toggle; and means for displacing the flipper mechanism connected to the spring to move the bridge portion with the electrical contact away from the switch terminal to stop electrical communication between the electrical contact and the switch terminal.

A device has been described that includes a cradle comprising a trough; and a terminal, wherein one of the cradle and the terminal comprises a connection portion and the other of the cradle and the terminal comprises a slip receiver formed therein for slidably receiving the connection portion to establish an electrical connection between the cradle and the terminal. In an exemplary embodiment, the cradle comprises the connection portion and the terminal comprises the receiver and is configured to receive a screw. In an exemplary embodiment, the terminal comprises a main wall and the receiver extends from the main wall at an angle between about 70° and 90°. In an exemplary embodiment, the receiver is formed by bending a single plate. In an exemplary embodiment, the receiver comprises two arms comprising diverging edge portions. In an exemplary embodiment, the receiver comprises first and second arms and a bridge connecting the first and second arms. In an exemplary embodiment, the first arm comprises a first portion extending from the bridge and comprises a second portion extending from the first portion, the first portion being disposed a first distance from the second arm and the second portion being disposed a second distance from the second arm. In an exemplary embodiment, the first distance is greater than the second distance. In an exemplary embodiment, the first arm is supported entirely by the bridge. In an exemplary embodiment, the receiver is configured to elastically deform about the bridge portion to receive the connection portion. In an exemplary embodiment, the connection portion comprises a rectangular plate. In an exemplary embodiment, the connection portion is movable along a plane within the slip receiver. In an exemplary embodiment, the cradle comprises a body portion defining a central aperture, the trough being formed in the body portion. In an exemplary embodiment, the cradle is independently adjustable relative to the terminal while the connection portion is disposed within the slip receiver. In an exemplary embodiment, the cradle comprises a U-shaped body portion comprising legs, and wherein the trough is formed in the legs of the body portion. In an exemplary embodiment, the system comprises a plurality of cradles and a single terminal, wherein the terminal comprises a plurality of slip receivers and each one of the plurality of cradles comprises a connection portion receivable in a respective one of the plurality of slip receivers. In an exemplary embodiment, the terminal comprises three slip receivers for connecting with three cradles.

A device has been described that includes a top housing comprising a switch portion; a bottom housing coupled to the top housing; a U-shaped flipper mechanism disposed in the bottom housing and comprising a bridge portion and first and second arms connected by the bridge portion, the first and second arms each comprising an oppositely extending protruding portion, each protruding portion comprising a lower cradle interfacing edge, wherein the bridge portion comprises a spring interface portion extending between the first and second arms toward the switching component, the spring interface portion comprising a base portion with a first width and comprising a central region with a second width, the second width being greater than the first width, the bridge portion comprising a centrally disposed electrical contact; a switch terminal disposed in the bottom housing and comprising a screw receiving aperture and an electrical contact; a cradle disposed in the bottom housing and comprising a body portion, a transition portion, and a connection portion, wherein the body portion has a central aperture and a U-shaped trough, wherein the transition portion is bent from the body portion and extends between the body portion and the connection portion, and wherein the connection portion is a rectangular plate extending away from the body portion, and wherein the flipper mechanism is disposed to extend through the central aperture in a manner that the cradle interfacing edge of the flipper mechanism extends into and contacts the trough, and wherein the flipper mechanism is suspended by the cradle and is movable in a manner that brings the electrical contact on the bridge portion of the flipper mechanism into contact with and out of contact with the electrical contact on the switch terminal; and a common terminal comprising a main wall with a screw aperture and comprising a slip receiver connected to and angled away from the main wall, the slip receiver comprising first and second walls connected by an integral receiver bridge, the first wall comprising a first and a second portion, the first portion being spaced a first distance from the second wall, the second portion extending from the first portion and being spaced a second distance from the second wall, the first distance being greater than the second distance, wherein the second wall is directly connected to the main wall and the first wall is supported by the second wall through the receiver bridge, wherein the connection portion of the cradle is disposed between the first and second walls of the slip receiver in a manner to complete an electrical connection between the cradle and the common terminal, the connection portion of the cradle being moveable within the slip receiver in any direction of a plane while maintaining the electrical connection, the common terminal comprising receptacle contacts disposed in a receptacle portion of the bottom housing.

A method has been described that includes inserting a terminal into a bottom housing; introducing a cradle into the bottom housing, the cradle comprising a body portion comprising troughs formed therein; and electrically coupling the cradle and the terminal by inserting a connector portion of one of the cradle and the terminal with a slip receiver of the other of the cradle and the terminal. In an exemplary embodiment, the method comprises adjusting the connector portion within the slip receiver while manipulating the cradle into a desired position within the housing. In an exemplary embodiment, adjusting the connector portion within the slip receiver comprises sliding the connector portion in at least one of a generally longitudinal direction and a generally transverse direction in a single plane. In an exemplary embodiment, the cradle comprises the connection portion and the terminal comprises the receiver and a screw receiving portion, and the method further comprises introducing the connector portion through a top portion of the slip receiver. In an exemplary embodiment, the method comprises introducing a flipper mechanism into the troughs in the cradle to establish an electrical coupling between the flipper mechanism and the terminal though the connector portion and the slip receiver. In an exemplary embodiment, the method comprises elastically deforming the slip receiver to receive the connection portion. In an exemplary embodiment, the elastically deforming step is accomplished by inserting the connector portion between first and second walls of the slip receiver. In an exemplary embodiment, the method comprises introducing a second cradle into the bottom housing, the second cradle comprising a body portion comprising troughs formed therein; and electrically coupling the second cradle and the terminal by inserting a connector portion of one of the second cradle and the terminal with a slip receiver of the other of the second cradle and the terminal. In an exemplary embodiment, the method comprises introducing two additional cradles into the bottom housing, and connecting the two additional cradles and terminal by inserting a connection portion of each of the two additional cradles into two additional slip receivers on the terminal. In an exemplary embodiment, the method comprises aligning the cradle in the bottom housing so that the cradle interfaces with housing features to secure the cradle in the housing.

A method has been described that includes inserting a common terminal into a bottom housing of an electrical device, the common terminal comprising a main wall with a screw receiving aperture and comprising a slip receiver connected to and angled away from the main wall, the slip receiver comprising first and second walls connected by an integral receiver bridge, the first wall comprising a first and a second portion, the first portion being spaced a first distance from the second wall, the second portion extending from the first portion being spaced a second distance from the second wall, the first distance being greater than the second distance, wherein the second wall is directly connected to the main wall and the first wall is supported by the second wall; introducing a cradle into the bottom housing, the cradle comprising a body portion, a transition portion, and a connection portion, wherein the body portion has a central aperture and a U-shaped trough, wherein the transition portion is bent from the body portion and extends between the body portion and the connection portion, and wherein the connection portion is a rectangular plate extending away from the transition portion; connecting the cradle and the terminal by inserting the connector portion between the first and second walls of the slip receiver in a manner to complete an electrical connection between the cradle and the common terminal; adjusting the connector portion within the slip receiver while manipulating the cradle into a desired position within the housing, comprising sliding the connector portion in both of longitudinal and transverse directions in a single plane; and introducing a flipper mechanism into the bottom housing through the central aperture of the cradle in a manner that a cradle interfacing edge of the flipper portion extends into and contacts the trough, and wherein the flipper mechanism is suspended by the cradle and the flipper mechanism is movable in a manner that brings an electrical contact on a bridge portion of the flipper into contact with and out of contact with an electrical contact on a switch terminal.

A system has been described that includes means for inserting a terminal into a bottom housing; means for introducing a cradle into the bottom housing, the cradle comprising a body portion comprising troughs formed therein; and means for electrically coupling the cradle and the terminal by inserting a connector portion of one of the cradle and the terminal with a slip receiver of the other of the cradle and the terminal. In an exemplary embodiment, the system comprises means for adjusting the connector portion within the slip receiver while manipulating the cradle into a desired position within the housing. In an exemplary embodiment, the means for adjusting the connector portion within the slip receiver comprises means for sliding the connector portion in at least one of a generally longitudinal direction and a generally transverse direction in a single plane. In an exemplary embodiment, the cradle comprises the connection portion and the terminal comprises the receiver and a screw receiving portion, and the system further comprises means for introducing the connector portion through a top portion of the slip receiver. In an exemplary embodiment, the system comprises means for introducing a flipper mechanism into the troughs in the cradle to establish an electrical coupling between the flipper mechanism and the terminal though the connector portion and the slip receiver. In an exemplary embodiment, the system comprises means for elastically deforming the slip receiver to receive the connection portion. In an exemplary embodiment, the means for elastically deforming step comprises means for inserting the connector portion between first and second walls of the slip receiver. In an exemplary embodiment, the system comprises means for introducing a second cradle into the bottom housing, the second cradle comprising a body portion comprising troughs formed therein; and means for electrically coupling the second cradle and the terminal by inserting a connector portion of one of the second cradle and the terminal with a slip receiver of the other of the second cradle and the terminal. In an exemplary embodiment, the system comprises means for introducing two additional cradles into the bottom housing, and connecting the two additional cradles and terminal by inserting a connection portion of each of the two additional cradles into two additional slip receivers on the terminal. In an exemplary embodiment, the system comprises means for aligning the cradle in the bottom housing so that the cradle interfaces with housing features to secure the cradle in the housing.

A system has been described that includes means for inserting a common terminal into a bottom housing of an electrical device, the common terminal comprising a main wall with a screw receiving aperture and comprising a slip receiver connected to and angled away from the main wall, the slip receiver comprising first and second walls connected by an integral receiver bridge, the first wall comprising a first and a second portion, the first portion being spaced a first distance from the second wall, the second portion extending from the first portion being spaced a second distance from the second wall, the first distance being greater than the second distance, wherein the second wall is directly connected to the main wall and the first wall is supported by the second wall; means for introducing a cradle into the bottom housing, the cradle comprising a body portion, a transition portion, and a connection portion, wherein the body portion has a central aperture and a U-shaped trough, wherein the transition portion is bent from the body portion and extends between the body portion and the connection portion, and wherein the connection portion is a rectangular plate extending away from the transition portion; means for connecting the cradle and the terminal by inserting the connector portion between the first and second walls of the slip receiver in a manner to complete an electrical connection between the cradle and the common terminal; means for adjusting the connector portion within the slip receiver while manipulating the cradle into a desired position within the housing, comprising sliding the connector portion in both of longitudinal and transverse directions in a single plane; and means for introducing a flipper mechanism into the bottom housing through the central aperture of the cradle in a manner that a cradle interfacing edge of the flipper portion extends into and contacts the trough, and wherein the flipper mechanism is suspended by the cradle and the flipper mechanism is movable in a manner that brings an electrical contact on a bridge portion of the flipper into contact with and out of contact with an electrical contact on a switch terminal.

A device as been described including a terminal; and a cradle comprising a plurality of integral cradle support regions, each cradle support region comprising a trough formed therein and being in electrical communication with the terminal. In an exemplary embodiment, the cradle comprises three cradle support regions. In an exemplary embodiment, the cradle comprises at least one neck extending between the plurality of cradle support regions, the neck comprising a width less than a width of the cradle support regions. In an exemplary embodiment, the cradle comprises a central aperture formed in each of the cradle support regions. In an exemplary embodiment, the cradle support regions are substantially rectangular. In an exemplary embodiment, the trough extends in a substantially straight line across the cradle. In an exemplary embodiment, the cradle comprises a shoulder formed at an end portion, the shoulder being configured to interface with a portion of an electrical housing to secure the cradle in place in the housing. In an exemplary embodiment, the terminal comprises a single slip receiver and the cradle comprises a single connecting portion interfacing with the slip receiver to provide the electrical communication, and wherein each of the plurality of cradle support regions is in electrical communication with the terminal through the single connecting portion. In an exemplary embodiment, the connecting portion is a plate formed along a plane substantially perpendicular to a longitudinal axis defined by the cradle. In an exemplary embodiment, the connection portion extends from a single end region of the cradle. In an exemplary embodiment, the device comprises a plurality of flipper mechanisms in electrical contact with the trough of each cradle support region.

A device has been described that includes a top housing; a bottom housing coupled to the top housing, the bottom housing comprising cradle support posts extending transversely within the bottom housing that comprise a boundary level and a support level; first, second, and third paddles associated with the top housing; first, second, and third actuators extending from the respective first, second, and third paddles; first, second, and third coil springs extending from the respective first second, and third actuators; first, second, and third U-shaped flipper mechanisms associated with the respective first, second, and third coil springs, each flipper mechanism comprising first and second arms connected by a bridge portion, the first and second arms each comprising an oppositely extending protruding portion, each protruding portion comprising a lower cradle interfacing edge, wherein the bridge portion comprises a spring interface portion extending between the first and second arms, the bridge portion comprising a centrally disposed electrical contact; first, second, and third switch terminals disposed in the bottom housing, each switch terminal comprising a screw receiving aperture and an electrical contact; a single cradle comprising first and second ends and being disposed in the bottom housing, the cradle comprising a body portion, a transition portion, and a single connection portion, the body portion being formed of first, second, and third integral cradle support regions separated by a first and a second neck comprising a width less than a width of the cradle support regions such that a shoulder is formed where each cradle support region meets the first and second neck, wherein the cradle comprises a centrally formed trough extending through each cradle support region, and wherein a shoulder portion is formed at the first and second ends, wherein the transition portion is bent from the body portion and extends between the body portion and the connection portion, wherein the connection portion is a rectangular plate, and wherein each of the first, second, and third cradle support regions comprise a central aperture, and wherein the cradle is disposed to interface with the cradle support posts so that the cradle rests on the support level of the cradle support posts and adjacent to the boundary level of the cradle support posts, wherein the first, second, and third flipper mechanisms are disposed to extend through the central aperture of each of the respective first, second, and third cradle support regions in a manner that the cradle interfacing edge of each flipper mechanism extends into and contacts the trough of each respective cradle support region, and wherein each flipper mechanism is suspended by the respective troughs and is movable in a manner that brings the electrical contact on the bridge portion of each respective flipper mechanism into contact with and out of contact with the electrical contact on the respective first, second, and third switch terminals; a common terminal comprising a main wall, a slip receiver, and a cantilevered pushwire arm, the main wall comprising a screw receiving aperture, the slip receiver being connected to and angled away from the main wall, the slip receiver comprising first and second walls connected by an integral receiver bridge, wherein the second wall is directly connected to the main wall and the first wall is supported by the second wall; and wherein the single connection portion of the cradle is disposed between the first and second walls of the slip receiver in a manner to complete an electrical connection between the cradle and the common terminal, the connection portion of the cradle being moveable within the slip receiver in any direction of a plane, the common terminal comprising receptacle contacts disposed in a receptacle portion of the bottom housing.

A method has been described that includes providing an electrical terminal; and electrically coupling a cradle to the terminal, the cradle comprising a plurality of integral cradle support regions, each cradle support region comprising a trough formed therein. In an exemplary embodiment, the method comprises placing the cradle in a housing, wherein the cradle comprises a plurality of shoulder features configured to interface with housing features to secure the cradle in the housing. In an exemplary embodiment, the method comprises introducing a flipper mechanism into a central aperture formed in each of the plurality of cradle support regions. In an exemplary embodiment, the method comprises interfacing the flipper mechanism with the trough. In an exemplary embodiment, the terminal comprises a slip receiver and the cradle comprises a connecting portion configured to interface with the slip receiver, and wherein electrically coupling the cradle to the terminal comprises inserting the connecting portion in the slip receiver.

A method has been described that includes inserting a common terminal into a bottom housing of an electrical device, the common terminal comprising a main wall, a slip receiver, and a cantilevered pushwire arm, the main wall comprising a screw receiving aperture, the slip receiver being connected to and angled away from the main wall, the slip receiver comprising first and second walls connected by an integral receiver bridge, wherein the second wall is directly connected to the main wall and the first wall is supported by the second wall, the second wall being disposed closer to the screw receiving aperture than the second wall; introducing a cradle into the bottom housing, the cradle comprising a body portion, a transition portion, and a single connection portion, the body portion being formed of first, second, and third integral cradle support regions separated by a first and a second neck comprising widths less than a width of the cradle support regions such that a shoulder is formed where each cradle support region meets each neck, the cradle comprising a centrally formed trough extending from a first end to the second end, the trough extending through each cradle support region, and wherein a shoulder portion is formed at the first and second ends, wherein the transition portion is bent from the body portion and extends between the body portion and the connection portion, wherein the connection portion is a rectangular plate, and wherein the cradle support regions each comprise a central aperture, wherein introducing the cradle comprises orienting the cradle to fit between boundary levels of cradle support posts formed in the bottom housing and to fit upon support levels of the cradle support posts; electrically coupling the cradle and the terminal by inserting the connector portion between the first and second walls of the slip receiver in a manner to complete an electrical connection between the cradle and the common terminal; introducing a first, a second, and a third U-shaped flipper mechanism through the respective central aperture of the respective first, second, and third cradle support regions, each flipper mechanism comprising first and second arms connected by an integral bridge portion, the first and second arms each comprising an oppositely extending protruding portion, each protruding portion comprising a lower cradle interfacing edge, wherein the bridge portion comprises a spring interface portion extending between the first and second arms, the bridge portion comprising a centrally disposed electrical contact, wherein introducing the first, second, and third U-shaped flipper mechanisms through the respective central apertures comprises placing the first, second, and third flipper mechanisms to extend through the respective central apertures in a manner that the cradle interfacing edge of each flipper mechanism extends into and contacts the trough of each respective first, second, and third cradle support region, and wherein the first, second, and third flipper mechanisms are suspended by the cradle and are movable in a manner that brings the electrical contact on the bridge portion of the first, second, and third flipper mechanisms into contact with and out of contact with an electrical contact on respective first, second, and third switch terminals.

A system has been described that includes means for providing an electrical terminal; and means for electrically coupling a cradle to the terminal, the cradle comprising a plurality of integral cradle support regions, each cradle support region comprising a trough formed therein. In an exemplary embodiment, the system comprises means for placing the cradle in a housing, wherein the cradle comprises a plurality of shoulder features configured to interface with housing features to secure the cradle in the housing. In an exemplary embodiment, the system comprises means for introducing a flipper mechanism into a central aperture formed in each of the plurality of cradle support regions. In an exemplary embodiment, the system comprises means for interfacing the flipper mechanism with the trough. In an exemplary embodiment, the terminal comprises a slip receiver and the cradle comprises a connecting portion configured to interface with the slip receiver, and wherein the means for electrically coupling the cradle to the terminal comprises means for inserting the connecting portion in the slip receiver.

A system has been described means for inserting a common terminal into a bottom housing of an electrical device, the common terminal comprising a main wall, a slip receiver, and a cantilevered pushwire arm, the main wall comprising a screw receiving aperture, the slip receiver being connected to and angled away from the main wall, the slip receiver comprising first and second walls connected by an integral receiver bridge, wherein the second wall is directly connected to the main wall and the first wall is supported by the second wall, the second wall being disposed closer to the screw receiving aperture than the second wall; means for introducing a cradle into the bottom housing, the cradle comprising a body portion, a transition portion, and a single connection portion, the body portion being formed of first, second, and third integral cradle support regions separated by a first and a second neck comprising widths less than a width of the cradle support regions such that a shoulder is formed where each cradle support region meets each neck, the cradle comprising a centrally formed trough extending from a first end to the second end, the trough extending through each cradle support region, and wherein a shoulder portion is formed at the first and second ends, wherein the transition portion is bent from the body portion and extends between the body portion and the connection portion, wherein the connection portion is a rectangular plate, and wherein the cradle support regions each comprise a central aperture, wherein the means for introducing the cradle comprises orienting the cradle to fit between boundary levels of cradle support posts formed in the bottom housing and to fit upon support levels of the cradle support posts; means for electrically coupling the cradle and the terminal by inserting the connector portion between the first and second walls of the slip receiver in a manner to complete an electrical connection between the cradle and the common terminal; means for introducing a first, a second, and a third U-shaped flipper mechanism through the respective central aperture of the respective first, second, and third cradle support regions, each flipper mechanism comprising first and second arms connected by an integral bridge portion, the first and second arms each comprising an oppositely extending protruding portion, each protruding portion comprising a lower cradle interfacing edge, wherein the bridge portion comprises a spring interface portion extending between the first and second arms, the bridge portion comprising a centrally disposed electrical contact, wherein the means for introducing the first, second, and third U-shaped flipper mechanisms through the respective central apertures comprises placing the first, second, and third flipper mechanisms to extend through the respective central apertures in a manner that the cradle interfacing edge of each flipper mechanism extends into and contacts the trough of each respective first, second, and third cradle support region, and wherein the first, second, and third flipper mechanisms are suspended by the cradle and are movable in a manner that brings the electrical contact on the bridge portion of the first, second, and third flipper mechanisms into contact with and out of contact with an electrical contact on respective first, second, and third switch terminals.

It is understood that the foregoing description describes examples only and the claims are intended to cover deviations from this disclosure. For example, in some embodiments, the screw apertures are slots configured to receive the screws. In other embodiments for example, the description of U-shaped troughs is meant to include troughs that have diverging or rounded walls.

Any spatial references such as, for example, "upper," "lower," "above," "below," "between," "vertical," "horizontal," "angular," "upward," "downward," "side-to-side," "left-to-right," "right-to-left," "top-to-bottom," "bottom-to-top," "left," "right," etc., are for the purpose of illustration only and do not limit the specific orientation or location of the structure described above.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several exemplary embodiments have been described in detail above, the embodiments described are exemplary only and are not limiting, and those skilled in the art will readily appreciate that many other modifications, changes and/or substitutions are possible in the exemplary embodiments without materially departing from the novel teachings and advantages of the present disclosure. Accordingly, all such modifications, changes and/or substitutions are intended to be included within the scope of this disclosure as defined in the following claims. In the claims, means-plus-function clauses are intended to cover the structures described herein as performing the recited function and not only structural equivalents, but also equivalent structures.

We claim:

1. A cradle for an electrical device, comprising:

a member comprising a plurality of integral cradle support regions, a trough being formed through each cradle support region, each cradle support region comprising an aperture that is configured to receive an actuator assembly, each actuator assembly being movable to open and close electrical connections in the electrical device when the cradle is installed in the electrical device.

2. The cradle of claim 1, wherein the member comprises three cradle support regions.

3. The cradle of claim 1, wherein the member comprises at least one neck extending between adjacent ones of the plurality of cradle support regions, each neck having a width less than a width of each of the cradle support regions.

4. The cradle of claim 1, wherein each aperture is substantially centrally disposed within its cradle support region.

5. The cradle of claim 4, wherein each of the cradle support regions has a substantially rectangular shape.

6. The cradle of claim 1, wherein the trough extends in a substantially straight line across the cradle.

7. The cradle of claim 1, wherein the member further comprises a shoulder formed at an end thereof, the shoulder being configured to interface with a portion of an electrical housing of the electrical device to secure the cradle in place in the housing.

8. The cradle of claim 1, wherein the member further comprises a single connecting portion configured to interface with a single slip receiver of a terminal with which the cradle is in electrical communication when the cradle is installed in the electrical device, wherein each of the plurality of cradle support regions is in electrical communication with the terminal only through the single connecting portion.

9. The cradle of claim 8, wherein the connecting portion is a plate formed along a plane substantially perpendicular to a longitudinal axis defined by the cradle.

10. The cradle of claim 8, wherein the connecting portion extends from a single end of the cradle.

11. The cradle of claim 1, further comprising the actuator assemblies, each actuator assembly comprising a flipper mechanism that is in electrical contact with the trough.

12. An electrical device, comprising:

a top housing;

a bottom housing coupled to the top housing, the bottom housing comprising cradle support posts extending transversely within the bottom housing that comprise a boundary level and a support level;

first, second, and third paddles associated with the top housing;

first, second, and third actuators extending from the respective first, second, and third paddles;

first, second, and third coil springs extending from the respective first second, and third actuators;

first, second, and third U-shaped flipper mechanisms associated with the respective first, second, and third coil springs, each flipper mechanism comprising first and second arms connected by a bridge portion, the first and second arms each comprising an oppositely extending protruding portion, each protruding portion comprising a lower cradle interfacing edge, wherein the bridge portion comprises a spring interface portion extending between the first and second arms, the bridge portion comprising a centrally disposed electrical contact;

first, second, and third switch terminals disposed in the bottom housing, each switch terminal comprising a screw receiving aperture and an electrical contact; and a single cradle comprising first and second ends and being disposed in the bottom housing, the cradle comprising a body portion, a transition portion, and a single connection portion, the body portion being formed of first, second, and third integral cradle support regions separated by a first and a second neck comprising a width less than a width of the cradle support regions such that a shoulder is formed where each cradle support region meets the first and second neck, wherein the cradle comprises a centrally formed trough extending through each cradle support region, and wherein a shoulder portion is formed at the first and second ends, wherein the transition portion is bent from the body portion and extends between the body portion and the connection portion, wherein the connection portion is a rectangular plate, and wherein each of the first, second, and third cradle support regions comprise a central aperture, and wherein the cradle is disposed to interface with the cradle support posts so that the cradle rests on the support level of the cradle support posts and adjacent to the boundary level of the cradle support posts, wherein the first, second, and third flipper mechanisms are disposed to extend through the central aperture of each of the respective first, second, and third cradle support regions in a manner that the cradle interfacing edge of each flipper mechanism extends into and contacts the trough of each respective cradle support region, and wherein each flipper mechanism is suspended by the respective troughs and is movable in a manner that brings the electrical contact on the bridge portion of each respective flipper mechanism into contact with and out of contact with the electrical contact on the respective first, second, and third switch terminals; and a common terminal comprising a main wall, a slip receiver, and a cantilevered pushwire arm, the main wall comprising a screw receiving aperture, the slip receiver being connected to and angled away from the main wall, the slip receiver comprising first and second walls connected by an integral receiver bridge, wherein the second wall is directly connected to the main wall and the first wall is supported by the second wall, wherein the single connection portion of the cradle is disposed between the first and second walls of the slip receiver in a manner to complete an electrical connection between the cradle and the common terminal, the connection portion of the cradle being moveable within the slip receiver in any direction of a plane, the common terminal comprising receptacle contacts disposed in a receptacle portion of the bottom housing.

13. A method, comprising the steps of:

inserting a common terminal into a bottom housing of an electrical device, the common terminal comprising a main wall, a slip receiver, and a cantilevered pushwire arm, the main wall comprising a screw receiving aperture, the slip receiver being connected to and angled away from the main wall, the slip receiver comprising first and second walls connected by an integral receiver bridge, wherein the second wall is directly connected to the main wall and the first wall is supported by the second wall, the second wall being disposed closer to the screw receiving aperture than the second wall;

introducing a cradle into the bottom housing, the cradle comprising a body portion, a transition portion, and a single connection portion, the body portion being formed of first, second, and third integral cradle support regions separated by a first and a second neck comprising widths less than a width of the cradle support regions such that a shoulder is formed where each cradle support region meets each neck, the cradle comprising a centrally formed trough extending from a first end to the second end, the trough extending through each cradle support region, and wherein a shoulder portion is formed at the first and second ends, wherein the transition portion is bent from the body portion and extends between the body portion and the connection portion, wherein the connection portion is a rectangular plate, and wherein the cradle support regions each comprise a central aperture, wherein introducing the cradle comprises orienting the cradle to fit between boundary levels of cradle support posts formed in the bottom housing and to fit upon support levels of the cradle support posts; and electrically coupling the cradle and the terminal by inserting the connector portion between the first and second walls of the slip receiver in a manner to complete an electrical connection between the cradle and the common terminal; and introducing a first, a second, and a third U-shaped flipper mechanism through the respective central aperture of the respective first, second, and third cradle support regions, each flipper mechanism comprising first and second arms connected by an integral bridge portion, the first and second arms each comprising an oppositely extending protruding portion, each protruding portion comprising a lower cradle interfacing edge, wherein the bridge portion comprises a spring interface portion extending between the first and second arms, the bridge portion comprising a centrally disposed electrical contact, wherein introducing the first, second, and third U-shaped flipper mechanisms through the respective central apertures comprises placing the first, second, and third flipper mechanisms to extend through the respective central apertures in a manner that the cradle interfacing edge of each flipper mechanism extends into and contacts the trough of each respective first, second, and third cradle support region, and wherein the first, second, and third flipper mechanisms are suspended by the cradle and are movable in a manner that brings the electrical contact on the bridge portion of the first, second, and third flipper mechanisms into contact with and out of contact with an electrical contact on respective first, second, and third switch terminals.

14. A system, comprising:

means for inserting a common terminal into a bottom housing of an electrical device, the common terminal comprising a main wall, a slip receiver, and a cantilevered pushwire arm, the main wall comprising a screw receiving aperture, the slip receiver being connected to and angled away from the main wall, the slip receiver comprising first and second walls connected by an integral receiver bridge, wherein the second wall is directly connected to the main wall and the first wall is supported by the second wall, the second wall being disposed closer to the screw receiving aperture than the second wall;

means for introducing a cradle into the bottom housing, the cradle comprising a body portion, a transition portion, and a single connection portion, the body portion being formed of first, second, and third integral cradle support regions separated by a first and a second neck comprising widths less than a width of the cradle support regions such that a shoulder is formed where each cradle support region meets each neck, the cradle comprising a centrally formed trough extending from a first end to the second end, the trough extending through each cradle support region, and wherein a shoulder portion is formed at the first and second ends, wherein the transition portion is bent from the body portion and extends between the body portion and the connection portion, wherein the connection portion is a rectangular plate, and wherein the cradle support regions each comprise a central aperture, wherein the means for introducing the cradle comprises orienting the cradle to fit between boundary levels of cradle support posts formed in the bottom housing and to fit upon support levels of the cradle support posts;

means for electrically coupling the cradle and the terminal by inserting the connector portion between the first and second walls of the slip receiver in a manner to complete an electrical connection between the cradle and the common terminal; and means for introducing a first, a second, and a third U-shaped flipper mechanism through the respective central aperture of the respective first, second, and third cradle support regions, each flipper mechanism comprising first and second arms connected by an integral bridge portion, the first and second arms each comprising an oppositely extending protruding portion, each protruding portion comprising a lower cradle interfacing edge, wherein the bridge portion comprises a spring interface portion extending between the first and second arms, the bridge portion comprising a centrally disposed electrical contact, wherein the means for introducing the first, second, and third U-shaped flipper mechanisms through the respective central apertures comprises placing the first, second, and third flipper mechanisms to extend through the respective central apertures in a manner that the cradle interfacing edge of each flipper mechanism extends into and contacts the trough of each respective first, second, and third cradle support region, and wherein the first, second, and third flipper mechanisms are suspended by the cradle and are movable in a manner that brings the electrical contact on the bridge portion of the first, second, and third flipper mechanisms into contact with and out of contact with an electrical contact on respective first, second, and third switch terminals.

15. A cradle for an electrical device, comprising:

a member comprising at least three integral cradle support regions, a trough being formed through each cradle support region, each cradle support region comprising an aperture that is configured to receive an actuator assembly, each actuator assembly being movable to open and close electrical connections in the electrical device when the cradle is installed in the electrical device.

16. The cradle of claim 15, wherein the member comprises at least one neck extending between adjacent ones of the plurality of cradle support regions, each neck having a width less than a width of each of the cradle support regions.

17. The cradle of claim 15, wherein each aperture is substantially centrally disposed within its cradle support region.

18. The cradle of claim 15, wherein each of the cradle support regions has a substantially rectangular shape.

19. The cradle of claim 15, wherein the trough extends in a substantially straight line across the cradle.

20. The cradle of claim 15, wherein the member further comprises a shoulder formed at an end thereof, the shoulder being configured to interface with a portion of an electrical housing of the electrical device to secure the cradle in place in the housing.

21. The cradle of claim 15, wherein the member further comprises a single connecting portion configured to interface with a single slip receiver of a terminal with which the cradle is in electrical communication when the cradle is installed in the electrical device, wherein each of the cradle support regions is in electrical communication with the terminal only through the single connecting portion.

22. The cradle of claim 21, wherein the connecting portion is a plate formed along a plane substantially perpendicular to a longitudinal axis defined by the cradle.

23. The cradle of claim 21, wherein the connecting portion extends from a single end of the cradle.

24. The cradle of claim 15, further comprising the actuator assemblies, each actuator assembly comprising a flipper mechanism that is in electrical contact with the trough.

* * * * *